US009636530B2

(12) United States Patent
Murray et al.

(10) Patent No.: US 9,636,530 B2
(45) Date of Patent: May 2, 2017

(54) STOVETOP FIRE SUPPRESSOR WITH THERMAL GLASS BULB ACTUATION AND METHOD

(71) Applicants: Donald W Murray, Arlington, TX (US); Richard M Anthony, River Oaks, TX (US)

(72) Inventors: Donald W Murray, Arlington, TX (US); Richard M Anthony, River Oaks, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 27 days.

(21) Appl. No.: 14/529,086

(22) Filed: Oct. 30, 2014

(65) Prior Publication Data

US 2015/0238790 A1 Aug. 27, 2015

Related U.S. Application Data

(63) Continuation-in-part of application No. 14/246,024, filed on Apr. 4, 2014.

(Continued)

(51) Int. Cl.

| | |
|---|---|
| ***A62C 3/00*** | (2006.01) |
| ***A62C 35/10*** | (2006.01) |
| ***A62C 37/14*** | (2006.01) |

(52) U.S. Cl.

CPC ..... *A62C 35/10* (2013.01); *A62C 3/006* (2013.01); *A62C 37/14* (2013.01)

(58) Field of Classification Search

CPC ..... A62C 3/006; A62C 35/10; A62C 37/11; A62C 37/14

See application file for complete search history.

(56) References Cited

U.S. PATENT DOCUMENTS

| | | | |
|---|---|---|---|
| 1,366,873 | A | 1/1921 | Carpenter |
| 1,766,912 | A | 6/1930 | Laengel |

(Continued)

FOREIGN PATENT DOCUMENTS

| | | |
|---|---|---|
| AU | 2015219475 | 8/2015 |
| AU | 2015219475 | 5/2016 |

OTHER PUBLICATIONS

PCT/US2015/014148 Invitation to Pay Additional Fees per Additional Invention, 2 pages, dated Mar. 24, 2015.

(Continued)

*Primary Examiner* — Ryan Reis
(74) *Attorney, Agent, or Firm* — Morani Patent Law, PC

(57) ABSTRACT

An automatic stovetop fire suppressor using a compressed spring to lower a bottom lid upon thermal glass bulb fracture is provided herein. A plastic lid seals on the bottom of a can and forms a closed container. The closed container is filled with a fire suppressing agent. A compressed spring extends when a thermal glass bulb fractures. The extending spring lowers the bottom lid to open the closed container. Fire suppressing agent flows out of the radial opening, suppressing a stovetop fire with minimal or no splashing of cooking oil. A center post is secured to a top wall of the container. A ledge, or bottom support, secured to the container catches the bottom lid to limit the radial opening height. A gradual release of a fire suppressing agent in a desired distribution pattern and method of gradual and spatial agent release can be provided with a cone-shaped bottom lid.

3 Claims, 33 Drawing Sheets

Related U.S. Application Data

(60) Provisional application No. 62/011,565, filed on Jun. 12, 2014, provisional application No. 61/943,017, filed on Feb. 21, 2014.

(56) References Cited

U.S. PATENT DOCUMENTS 1,816,892 A 8/1931 Bronander
2,025,326 A 12/1935 Bouillon
3,040,815 A 6/1962 Pambello
3,209,837 A 10/1965 Freedman
3,757,866 A 9/1973 Mears
3,773,111 A 11/1973 Dunn
3,782,475 A 1/1974 Schmidt
3,833,063 A 9/1974 Williams
3,874,458 A 4/1975 Williams
3,884,306 A * 5/1975 Williams ..... A62C 13/006 169/28
3,884,307 A 5/1975 Williams
3,897,826 A 8/1975 Hutchison
3,918,526 A * 11/1975 Hattori ..... A62D 1/0014 169/28
4,011,911 A 3/1977 Gow
4,023,494 A 5/1977 Barton
4,113,020 A 9/1978 Panetta
4,256,181 A 3/1981 Searcy
4,356,870 A * 11/1982 Gaylord ..... A62C 35/58 126/299 R
4,485,741 A 12/1984 Moore
4,813,487 A 3/1989 Mikulec
4,964,469 A 10/1990 Smith
5,094,298 A * 3/1992 Polan ..... A62C 37/09 169/19
5,297,636 A 3/1994 North
5,351,760 A 10/1994 Tabor
5,375,523 A 12/1994 Morris
5,518,075 A 5/1996 Williams
5,628,367 A 5/1997 Traux et al.
5,868,205 A 2/1999 Cunningham et al.
5,871,057 A 2/1999 Stehling et al.
5,881,819 A 3/1999 Walters et al.
5,899,278 A 5/1999 Mikulec
6,029,751 A 2/2000 Ford et al.
6,105,677 A * 8/2000 Stager ..... A62C 37/12 169/26
6,112,821 A * 9/2000 Yokoi ..... A62C 37/09 169/37
6,244,353 B1 6/2001 Greer
6,276,461 B1 8/2001 Stager
6,296,062 B1 * 10/2001 Sundholm ..... A62C 3/0221 169/37
6,796,382 B2 9/2004 Kaimart
7,182,143 B2 2/2007 Hall et al.
7,472,758 B1 1/2009 Stevens
7,610,966 B1 11/2009 Weintraub et al.
7,934,564 B1 5/2011 Stell et al.
7,969,296 B1 6/2011 Stell
8,294,567 B1 10/2012 Stell
8,517,117 B2 8/2013 Mikulec
2003/0010506 A1 1/2003 Braun
2008/0087446 A1 4/2008 Sitabkhan

OTHER PUBLICATIONS

PCT/US2015/014339 Invitation to Pay Additional Fees per Additional Invention, 2 pages, dated Mar. 27, 2015.

* cited by examiner

STOVETOP FIRE SUPPRESSOR WITH THERMAL GLASS BULB ACTUATION AND METHOD

CROSS REFERENCE TO RELATED APPLICATIONS

This application claims priority to U.S. Provisional Application No. 62/011,565, filed 12 Jun. 2014, the contents of which are incorporated herein by reference. Further, this application is a Continuation in Part and claims priority to U.S. patent application Ser. No. 14/246,024, filed 4 Apr. 2014, the entire contents of which are incorporated herein by reference. Said Continuation in Part application claims and U.S. patent application Ser. No. 14/246,024 claims priority to U.S. Provisional Application No. 61/943,017, filed 21 Feb. 2014, the entire contents of which are also incorporated herein by reference.

FIELD OF THE INVENTION

The present invention relates to a device and method of fire suppression, and more particularly to an automatic stovetop fire suppressor using thermal glass bulb actuation.

BACKGROUND OF THE INVENTION

Stovetop fires are a well-known residential and commercial hazard. An unattended stovetop fire, for example a grease fire, can cause damage to nearby appliances and cabinets. Worse, stovetop fires can lead to structural damage or injury. Because the propensity for stovetop fires is so pervasive, an efficient means of automatic fire suppression is desired. Even if a stovetop fire is attended, an automatic extinguishing method may be more effective and expedient compared to manual means.

A number of conventional automatic stovetop fire extinguishers, which mount above the stovetop surface, are available. These include: U.S. Pat. No. 6,105,677 to Stager using pressurized liquid; U.S. Pat. No. 6,276,461 to Stager using a pendulum device; U.S. Pat. No. 4,813,487 to Mikulec using a fluid under pressure device; U.S. Pat. No. 5,899,278 to Mikulec using fluid under pressure; U.S. Pat. No. 7,472,758 to Stevens and Weintraub using a fuse activated initiator; U.S. Pat. No. 5,518,075 to Williams using a self-contained device with fire suppressing powder-like agent; U.S. Pat. No. 4,256,181 to Searcy using pyrotechnic fuse; U.S. Pat. No. 5,297,636 to North using fluid under pressure; and U.S. Pat. No. 5,351,760 to Tabor using fluid under pressure.

The array of conventional fire suppression systems vary from pendulum swing apparatus (Stager '461), to canister systems (Williams '307 and Stager '677), or to tube connecting systems for fire suppressing liquid effluent under pressure (Mikulec '278, '487). The array of conventional fire suppression systems also vary across activation forms, for example, by: melting of a fusible pin (Stager '461); melting a solder fusible plug (Stager '677); melting solder and wire activation (North '636); melting a link (Tabor '760); to burning of a fuse (Williams '307, Stevens '758, Searcy '181); or to activating via a glass bulb fuse mechanism (Mikulec).

Conventional stovetop fire suppressors can include pressurized fluid with complex mounting mechanisms or may include a swinging pendulum mount. Liquid effluent stovetop fire extinguishers may be activated by melting of a meltable material, such as solder. Conventional stovetop fire suppressors with a particulate fire suppressing agent may activate by pyrotechnic charge containing initiators. Still other conventional pressurized liquid effluent stovetop fire suppressors may activate by thermal glass bulb.

In a stovetop fire condition, it may be desirable to provide a controlled release of a fire suppressing agent both in a pattern of distribution of the agent and in the release of the agent as a function of time. It is most desirable to an provide an early, reliable, and quick response to a fire condition. It may be desirable to provide a fire suppressor device in a closed container that is readily mounted above the stovetop cooking surface.

SUMMARY OF THE INVENTION

The present invention addresses some of the issues presented above by providing a controlled release of a fire suppressing agent via a thermal glass bulb activation in an automatic stovetop fire suppressor. Embodiments of the present invention may have any of the aspects below. Aspects of the present invention are provided for summary purposes and are not intended to be all inclusive or exclusive. Embodiments of the present invention may have any of the aspects below.

Conventionally, a fire suppressing agent deploys in a bulk release upon rupture of metal segments. It may be desirable to provide a gradual release of fire suppressing powder or powder-like agent over time. A gradual release over time may enable decreased or eliminated splash of liquid on the stovetop, which may be burning cooking oil. Further, a broader or directed distribution of the released fire suppressing agent may be desired. In addition, it may be desirable to eliminate the need for an initiator charge. A self contained stovetop fire suppressor which employs an activation method using a United Laboratories (UL) rated fuse may be desirable.

By departing from an activation process that includes the rupture of metal segments in a bottom container wall and by implementing an activation process which incorporates the release of compressed spring energy to deploy, to lower, a bottom lid, the present invention can employ a thermal glass bulb initiator. The thermal glass bulb initiator provides a multitude of desirable qualities to the automatic stovetop fire suppressor device and method. As applied in embodiments of the present fire suppressor invention, these qualities include predictable, consistent, early, and quick activation of the fire suppressing device.

One aspect of the present invention is to provide a user friendly method of suppressing a stovetop fire.

Another aspect of the present invention is to provide an automated release of fire suppressing agent in the presence of a stovetop fire.

Another aspect of the present invention is to provide a flow of fire suppressing agent upon activation of the stovetop fire suppressor.

Another aspect of the present invention is a mounting device and method, or compatibility with the same, which affords full and proper function of a stovetop fire suppressor mounted beneath a vent hood.

Another aspect of the present invention is to be compatible with a convenient mounting device for a micro-hood stovetop environment.

Yet another aspect of the present invention is to provide a consistent release of fire suppressing agent upon activation of the stove top fire suppressor.

Another aspect of the present invention is to provide a gradual release of fire suppressing agent over time.

Another aspect of the present invention is to provide a desired distribution pattern of fire suppressing agent in a fire condition.

Another aspect of the present invention is to provide a closed fire extinguishing container in an inactivated state.

Another aspect of the present invention is the ability to use off the shelf parts in the stovetop fire suppressing device.

Yet another aspect of the present invention is to provide stovetop fire suppressor using a combination of ready made and custom made parts.

Another aspect of the present invention is a relative ease of use in employment of the present invention in field applications.

Another aspect of the present invention is a method of using a collapsible or breakable lever to maintain the fire suppressor container in a closed inactivated state.

Another aspect of the present invention is a method of releasing the fire suppressing agent upon breaking of thermal glass bulb.

Still another aspect of the present invention is the release of compressed spring energy to activate the stovetop fire suppressor.

Another aspect of the present invention is a method of lowering a bottom lid to release the fire suppressing agent from the closed container.

Still another aspect of the present invention is the use of plastic for the bottom lid of the fire suppressor container.

Another aspect of the present invention is the containment of the fire suppressing agent in a closed container from manufactured end to activation of the device in a fire condition.

Another aspect of the present invention is a method of releasing the fire suppressing agent upon lowering of the bottom lid.

Another aspect of the present invention is the use of a thermal fuse bearing the UL Mark in the initiator of the fire suppressing device.

Another aspect of the present invention is open air exposure of a thermal sensitive fuse above the stovetop cooking surface.

Another aspect of the present invention is the positioning of the thermal sensitive fuse on an outer side of and beneath a bottom plastic lid.

Another aspect of the present invention is the ability to vary the distribution pattern of the fire suppressing agent by changing the cone angle of the container bottom lid.

Another aspect of the present invention is the ability to vary the release time of the fire suppressing agent by varying the drop height of the cone lid upon activation.

Another aspect of the present invention is the ability to vary the release time of the fire suppressing agent by varying both of the cone angle of the container bottom lid and the drop height of the cone lid upon activation.

Still another aspect of the present invention is the use of thermo-molding to create a custom container bottom lid.

In still another aspect of the present invention, the lid pattern is concave or convex.

In still another aspect of the present invention is the use of mechanical fingers integral to the container bottom lid to limit the drop height of the lid on activation.

Another aspect of the present invention is a catching surface on a lower cotter pin and bulb support for the center guide of the container bottom lid.

Another aspect of the present invention is a catching surface on a lower headed pin, or nail, and bulb support for the center guide of the container bottom lid.

Another aspect of the present invention is the use of a ready-made threaded insert to secure a center post to a top of the fire suppressor container and to enable mounting of the fire suppressor above the stovetop.

Another aspect of the present invention is to use a commercially available can in the fire suppressor container assembly.

Another aspect of the present invention is to use a combination of an aluminum can and a plastic bottom lid to form a closed container for a fire suppressing agent.

Another aspect of the present invention is to modify the aluminum can to form a catching surface for the container bottom lid upon activation of the fire suppressor.

Still another aspect of the present invention is the use of a plastic cylindrical center post affixed to a top wall of the can with a ready made insert.

Another aspect of the present invention is securing the center shaft to a top wall of the container for the fire suppressing device.

Still another aspect of the present invention is the use of a plastic custom made cone shaped bottom lid.

Still another aspect of the present invention is thermo-molding a center cylindrical post with an integral spring extension surface.

Still another aspect of the present invention is the use of a cylindrical guide base in the bottom lid.

Still another aspect of the present invention is the dropping of an integral guide base upon activation of the stovetop fire suppressor.

Still another aspect of the present invention is the use of a center shaft to maintain mechanical connection of the bottom lid to the can when the lid lowers for activation.

Still another aspect of the present invention may be the use of a cotter pin, a headed pin, a nail, an L shaped pin or alternate member as a center shaft.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across views refer to like elements for ease of reference. Reference numbers may also be unique to a respective figure or embodiment.

Figure 1A:
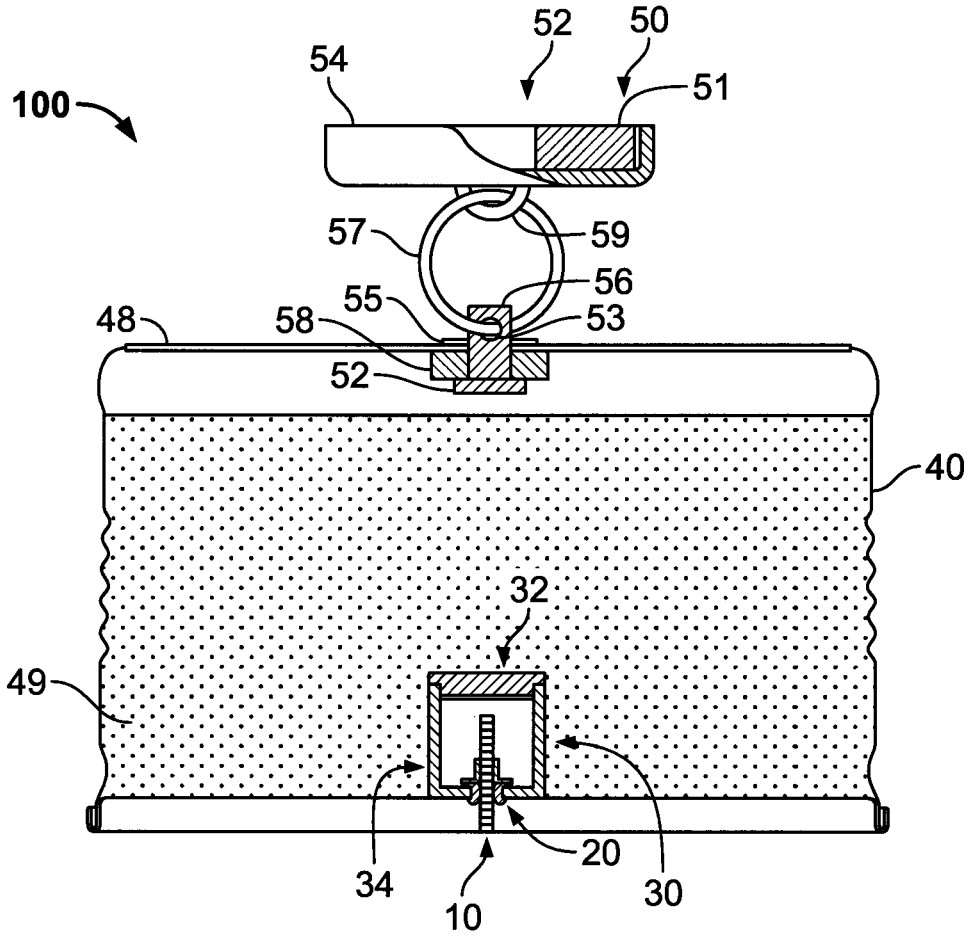
FIG. 1A Prior Art
FIG. 1A shows a partial cross section of a conventional stovetop fire suppressor for mounting under a vent-hood taken through the axial center.
Figure 1B:
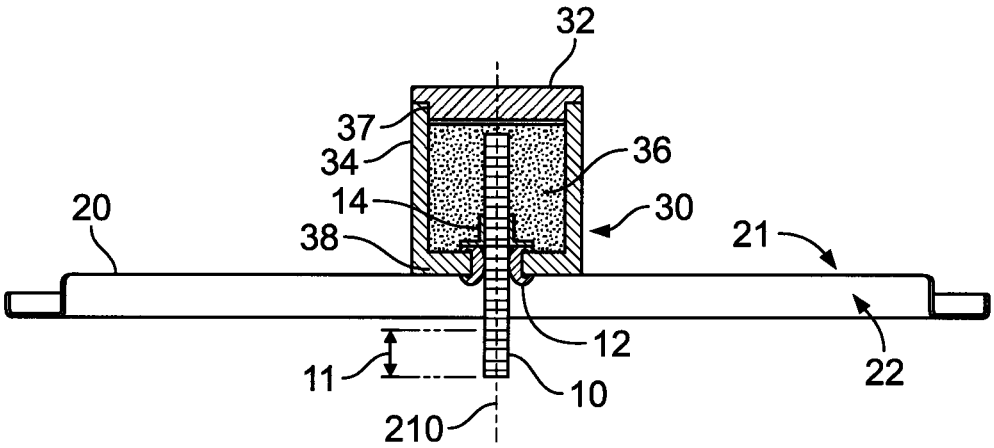
FIG. 1B Prior Art
FIG. 1B shows a partial cross section of a conventional stovetop fire suppressor initiator mounted in a conventional bottom lid taken along the axial center.
Figure 2:
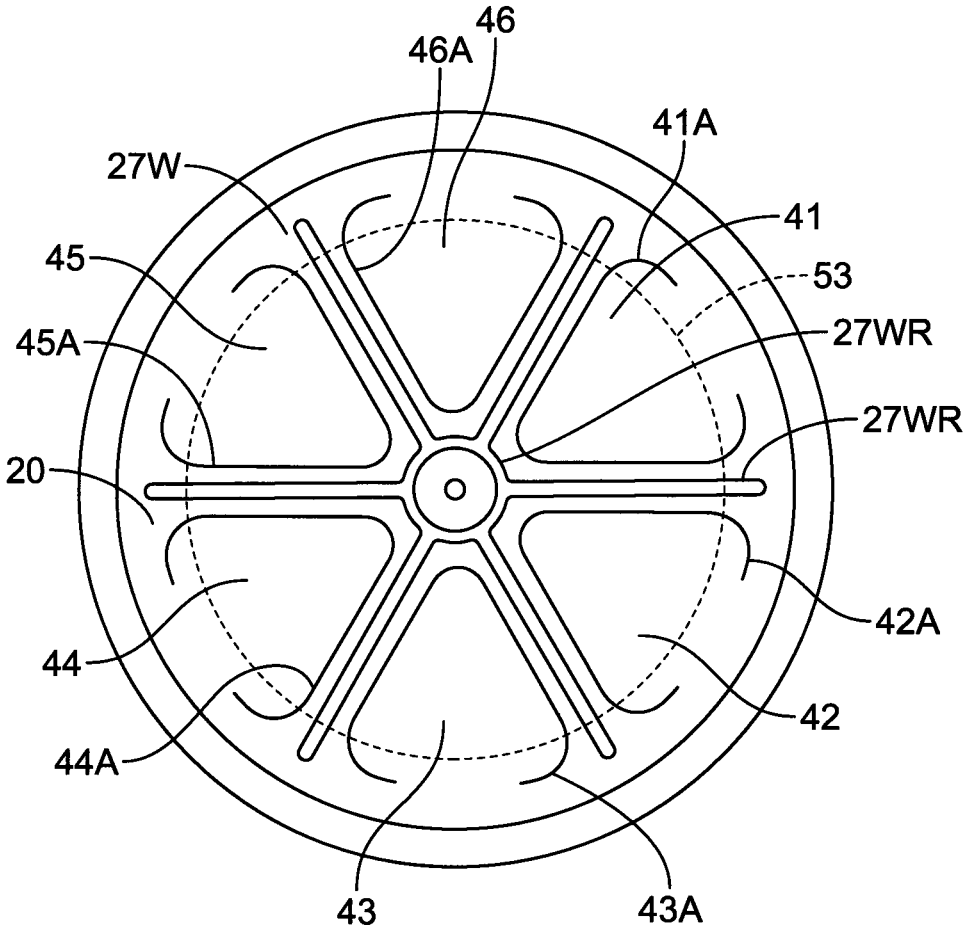
FIG. 2 Prior Art
FIG. 2 shows a bottom view of an outside of a container lid, in accordance with a conventional stovetop fire suppressor.

Conventional fire suppressors, STOVETOP FIRESTOP® fire suppressor (Williams-Pyro, Inc., Fort Worth, Tex., USA), which are particularly well suited to a stovetop environment, include a container of an extinguishing agent mounted to a vent hood above the stovetop and activated by a fuse. An example of such an suppressor is shown in FIGS. 1A, 1B and 2. FIG. 1A shows a partial cross section of a conventional stovetop fire suppressor for mounting under a vent-hood taken through the axial center. FIG. 1A is a cross sectional view along the center axis of a closed container automatic stovetop fire suppressor. Through the bottom wall or lid 20 of the container 40 extends a fuse 10. A fire on the stovetop ignites the fuse 10, which in turn detonates an initiator 30. The initiator 30 opens the bottom 20 of the container 40, thereby allowing the disbursement of the extinguishing agent 49 onto the fire and the stovetop. The container is secured via a magnet 50 to a hood over the stove. In a conventional stovetop fire suppressor, the initiator housing 34 is affixed to the bottom lid 20. The fuse 10 extends into the initiator housing 30, wherein an explosive charge is housed, charge not shown. Alternate, matter may be used for or in the initiator charge, such as black powder substitute.

FIG. 1B shows a partial cross section of a conventional stovetop fire suppressor initiator mounted in a conventional bottom lid taken along the axial center. An initiator housing cup 34 is affixed to a bottom lid 20. Eyelet 12 passes through an opening in the lid and through a bottom opening in the cup bottom wall 38 to secure the cup to the lid. The cup seats atop an inner 21 side of the lid. A fuse 10 has an eyelet 14 which rests atop the eyelet 12 inside cup 34. Fuse 10 extends from an inside of the cup to an outer 22 side of the lid 20. Eyelet 14 keeps the fuse 10 from falling out of the cup 34 and lid 20 combination. Housed within the cup is an initiator charge 36. The initiator is closed with a cap 32 ultrasonically welded to a top circumferential edge 37 of the cup 34. In practice the charge is ignited by the fuse and the activated initiator blows segments in the bottom lid open releasing the fire suppressing agent. With reference to FIG. 2, a bottom lid 20 of a conventional stovetop fire suppressor is described in greater detail.

FIG. 2 shows a bottom view of an outside of a container lid, in accordance with a conventional stovetop fire suppressor. Once assembled, the fuse extends through the lid 20 exposing its cut end past the outside side of the lid, fuse not shown. The bottom lid 20 has grooves or scored lines 41A-46A selectively formed on the outside thereof to facilitate breaking or rupturing of the bottom end into separate tear-open segments 41-46 without fragmentation to form openings 41B-46B, openings not shown, only in the bottom wall, lid 20, when the free ends of the segments are forced outward to allow the fire extinguishing powder 49, shown in FIG. 1A, to fall or pass outward from the container onto the fire. Although the scoring is illustrated on the outside surface of the lid it can be on the inside surface thereof. The fuse 10, shown in FIGS. 1A and 1B, is lit by a stovetop fire which burns into the into initiator 30 and ignites the charge 36. When this occurs, the force of the explosion ruptures the scored or weakened lines and forces the tear open segments 41-46 outward to form the openings 41B-46B. The fire extinguishing powder 49 then falls out of container 40, shown in FIG. 1A, for example, to extinguish any fire below which may be in a frying pan, for example.

Still referring to FIG. 2, the non-erupting portions of the lid 20 is referred to as the web 27W of the lid 20. Embossed reinforcing ribs 27WR are formed in the lid 20 to make the web 27W stiffer and to assist in minimizing any problem of the segments 41-46 or vanes not opening outward. The embossing forms a center circle with radially extending ribs between break open segments 41-46. The ribs 27WR may be formed by bending the web 27W outward after the score lines 41A are formed, which tends to pull metal away from the score lines 41A-46A and may facilitate opening of the segments 41-46.

Figure 3A:
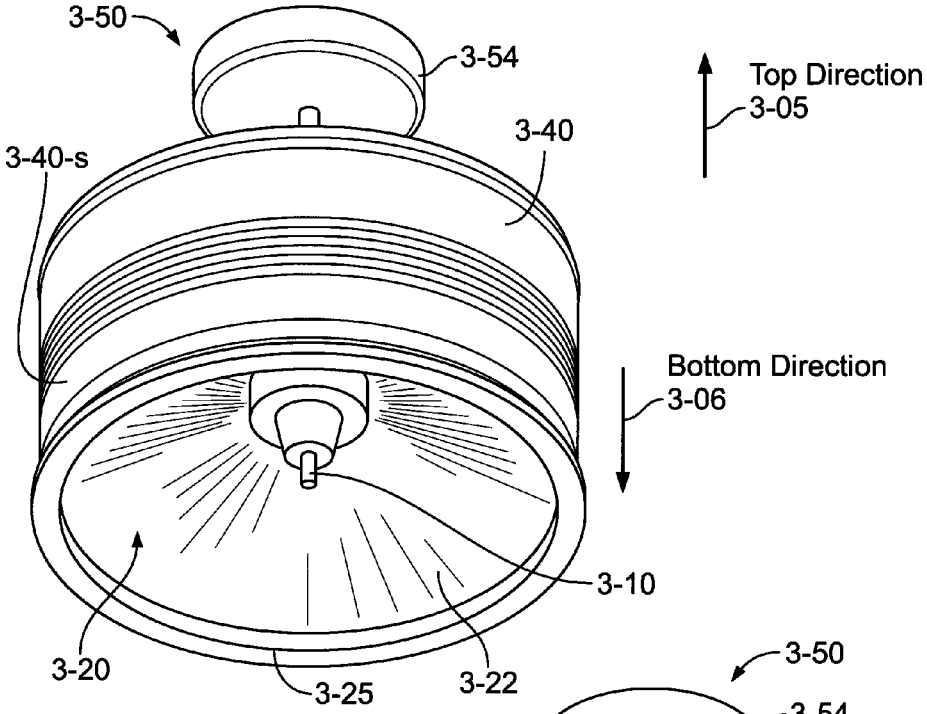
FIG. 3A shows a bottom perspective of an automatic stovetop fire suppressor in a closed state, in accordance with a cone shaped bottom lid, a fuse, and an initiator charge activated stovetop fire suppressor.

FIG. 3A shows a bottom perspective of an automatic stovetop fire suppressor in a closed state, in accordance with a cone shaped bottom lid, a fuse, and an initiator charge activated stovetop fire suppressor;

FIG. 3A shows a bottom perspective of an automatic stovetop fire suppressor in a closed state, in accordance with a cone shaped bottom lid 3-20, a fuse 3-10, and an initiator charge, not shown, activated stovetop fire suppressor. A mounting assembly 3-50 is shown at a top 3-05 of the figure with a magnet housing 3-54 also shown. In accordance with the exemplary embodiment of FIG. 3A, a magnet within housing 3-54 readily and easily secures the automatic stovetop fire suppressor to a vent hood above the stove surface. A fuse 3-10 extends from an inner housed initiator charge, not shown, past an outer surface 3-22 of the cone shaped bottom lid 3-20. At the outer edge of the lid 3-20 is the circumferential channel 3-25. A bottom 3-06 of the cylindrical side wall 3-40-*s* seals to the outer channel 3-25 of the cone shaped bottom lid 3-20.

Figure 3B:
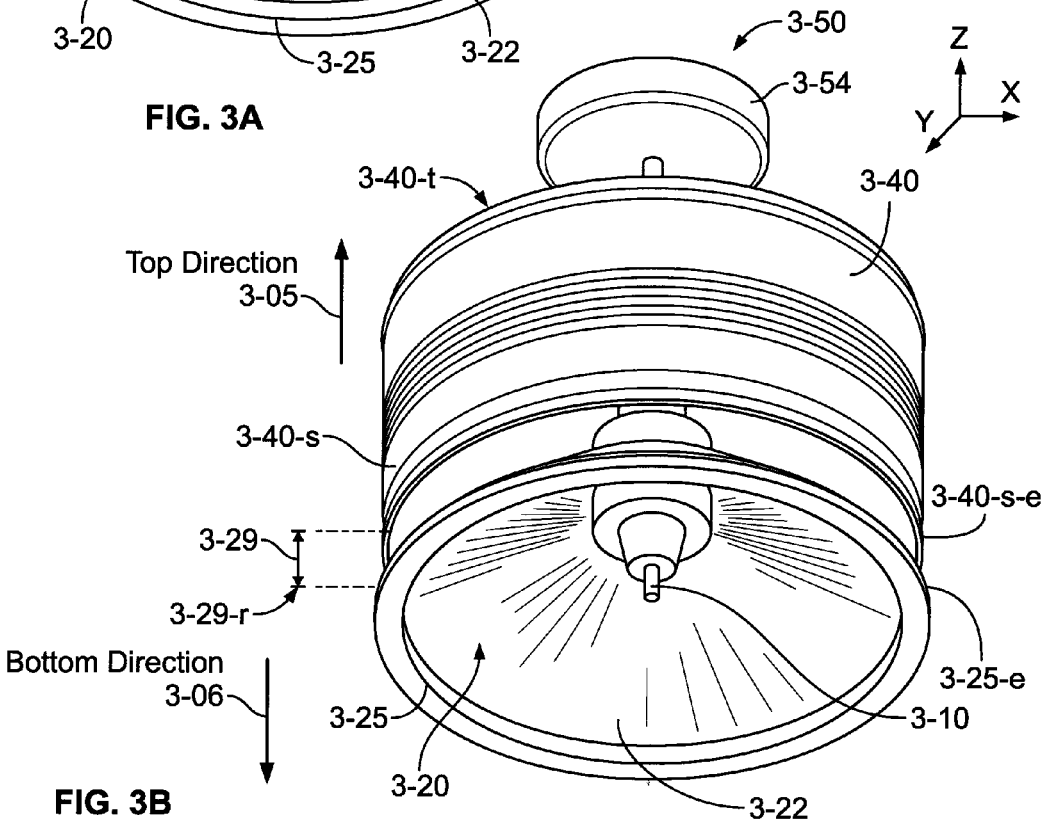
FIG. 3B shows a bottom perspective of an automatic stovetop fire suppressor in an open activated state, in accordance with a cone shaped bottom lid, a fuse, and an initiator charge activated stovetop fire suppressor.

FIG. 3B shows a bottom perspective of an automatic stovetop fire suppressor in an open activated state, in accordance with a cone shaped bottom lid, a fuse, and an initiator charge activated stovetop fire suppressor. In accordance with an initiator charge embodiment, a designed breaking point, for example of reduced cross section, breaks to release the cone shaped bottom lid 3-20. The initiator charge and interior designed breaking point are not shown in the perspective view of FIG. 3B but are shown, for example, in FIG. 3C and described in detail in parent application U.S. patent application Ser. No. 14/246,024, filed 4 Apr. 2014, which is incorporated by reference. Referring again to FIG. 3B, although the fire suppressor is shown in an activated state, the fuse 3-10 is shown in its inactivated state for illustration. Upon activation of the automatic stovetop fire suppressor, the initiator charge ignites, the designed breaking point breaks, and the cone shaped bottom lid 3-20 drops below a bottom edge 3-40-*s*-*e* of the side wall 3-40-*s* creating a radial opening 3-29*r*. The outer circumferential edge 3-25-*e* is shown displaced from a bottom edge 3-40-*s*-*e* of the side wall 3-40-*s*. In practice, the mounting assembly 3-50 remains secured above the stovetop surface to, for example, a vent hood. In accordance with an exemplary embodiment, a magnet, not shown, housed in a magnet housing 3-54 provides the mounting connection of the stovetop fire suppressor to the vent hood. In accordance with embodiments of the present invention, mounting devices may afford pivoting of the stovetop fire suppressor such that the bottom lid hangs parallel to the horizontal cooking surface even when the mounting surface is tilted to the horizontal. An example of such a mounting device is shown, for example, in FIG. 1A. Referring again to FIG. 3B, the circumferential channel 3-25 is shown displaced from a bottom edge 3-40-*s*-*e* of the cylindrical side wall 3-40-*s* by a drop height of 3-29. In accordance with an exemplary embodiment the drop height is greater than 0.20 inches. In accordance with another exemplary embodiment, the drop height is travel limited to 0.20 inches.

Figure 4A:
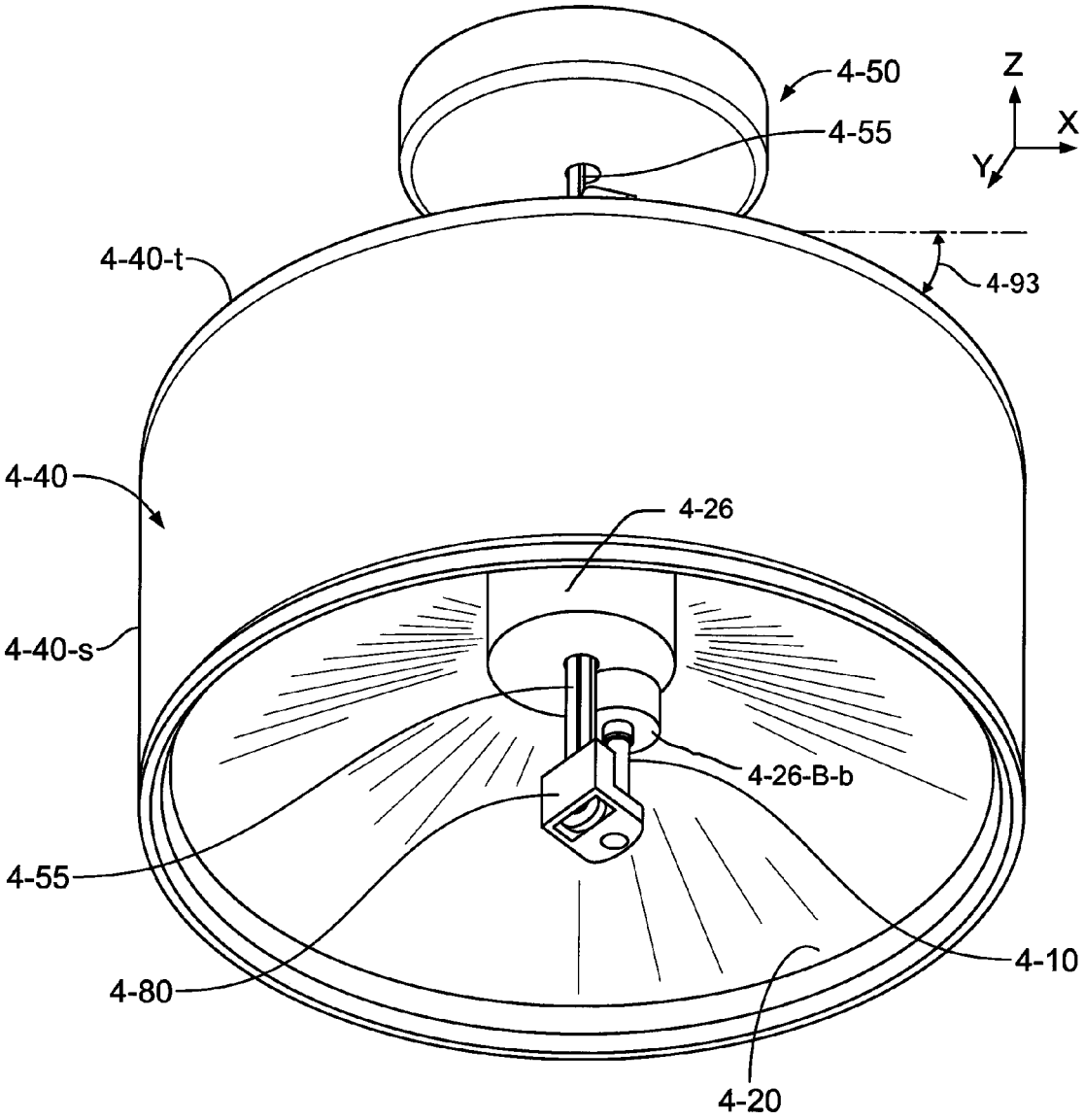
FIG. 4A shows a bottom perspective view of a stovetop fire suppressor, in accordance with an exemplary embodiment of the present invention.

FIG. 4A shows a bottom perspective view of a stovetop fire suppressor, in accordance with an exemplary embodiment of the present invention. Contrast to the fuse and initiator activated fire suppressor shown in FIG. 3A is readily apparent. Referring again to FIG. 4A, a pin and bulb support 4-80 is shown at the bottom center. Extending upwards Z from pin and bulb support 4-80 is a cotter pin 4-55 and a thermal glass bulb 4-10. A can 4-40 is shown with a cylindrical sidewall 4-40-*s* and a top 4-40-*t*. The top wall 4-40-*t* has an angle 4-93. In accordance with an exemplary embodiment, the angle 4-93 may be 20 degrees. Cotter pin 4-55 functions as the device center shaft and extends through the center of the can 4-40 and up into the mounting assembly 4-50. A cone shaped bottom lid 4-20 closes the fire suppressing device. At the center of the bottom lid is a center guide 4-26 with an extended piece on the right side, X direction, 4-26-B-b of the center guide extending below the shoulder of the guide 4-26, the shoulder and extended piece are further described below. In alternate exemplary embodiments, the center shaft 4-55 may be in an alternate form, for example, a headed pin, a nail, or an L shaped shaft.

Figure 4B:
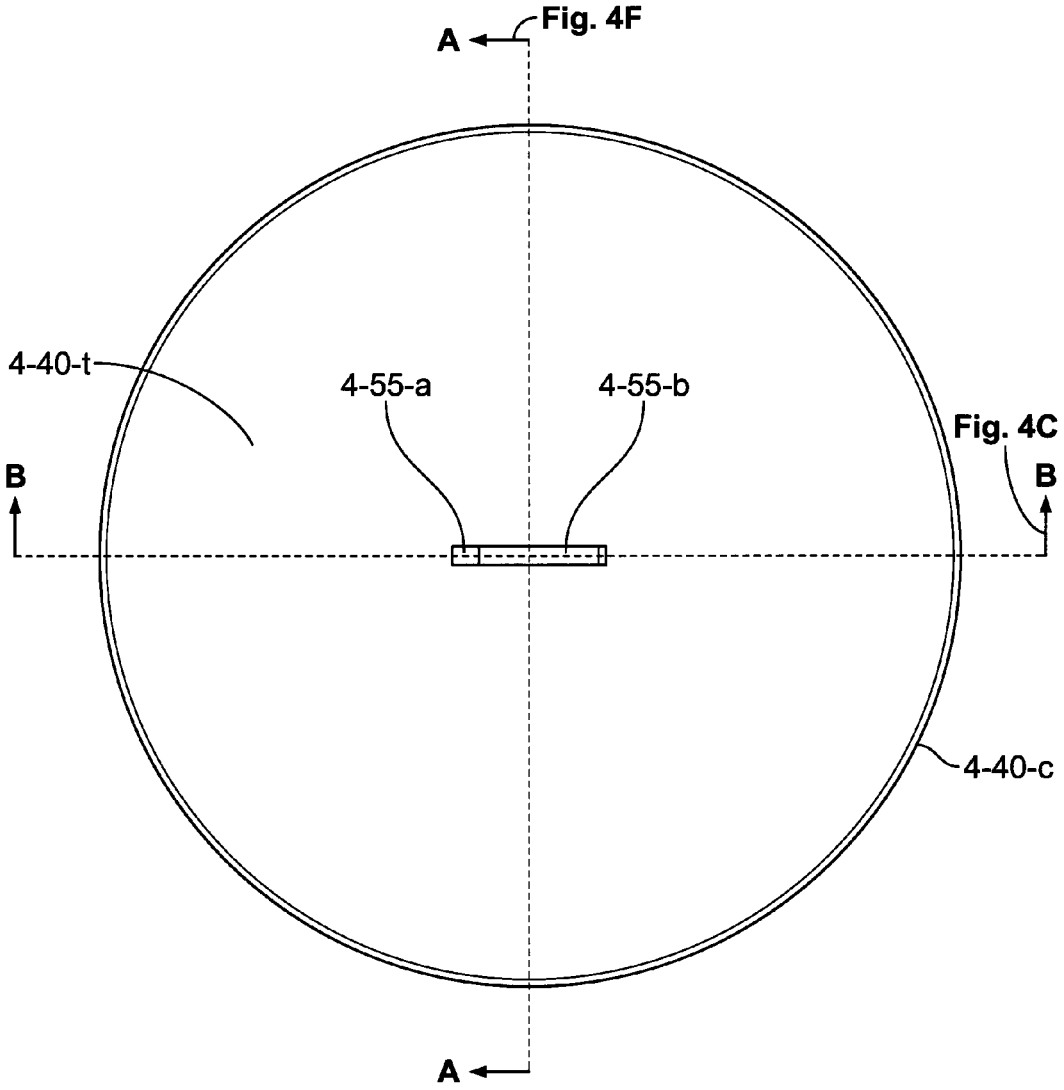
FIG. 4B shows a top view of a stovetop fire suppressor, in accordance with an exemplary embodiment of the present invention.
Figure 4C:
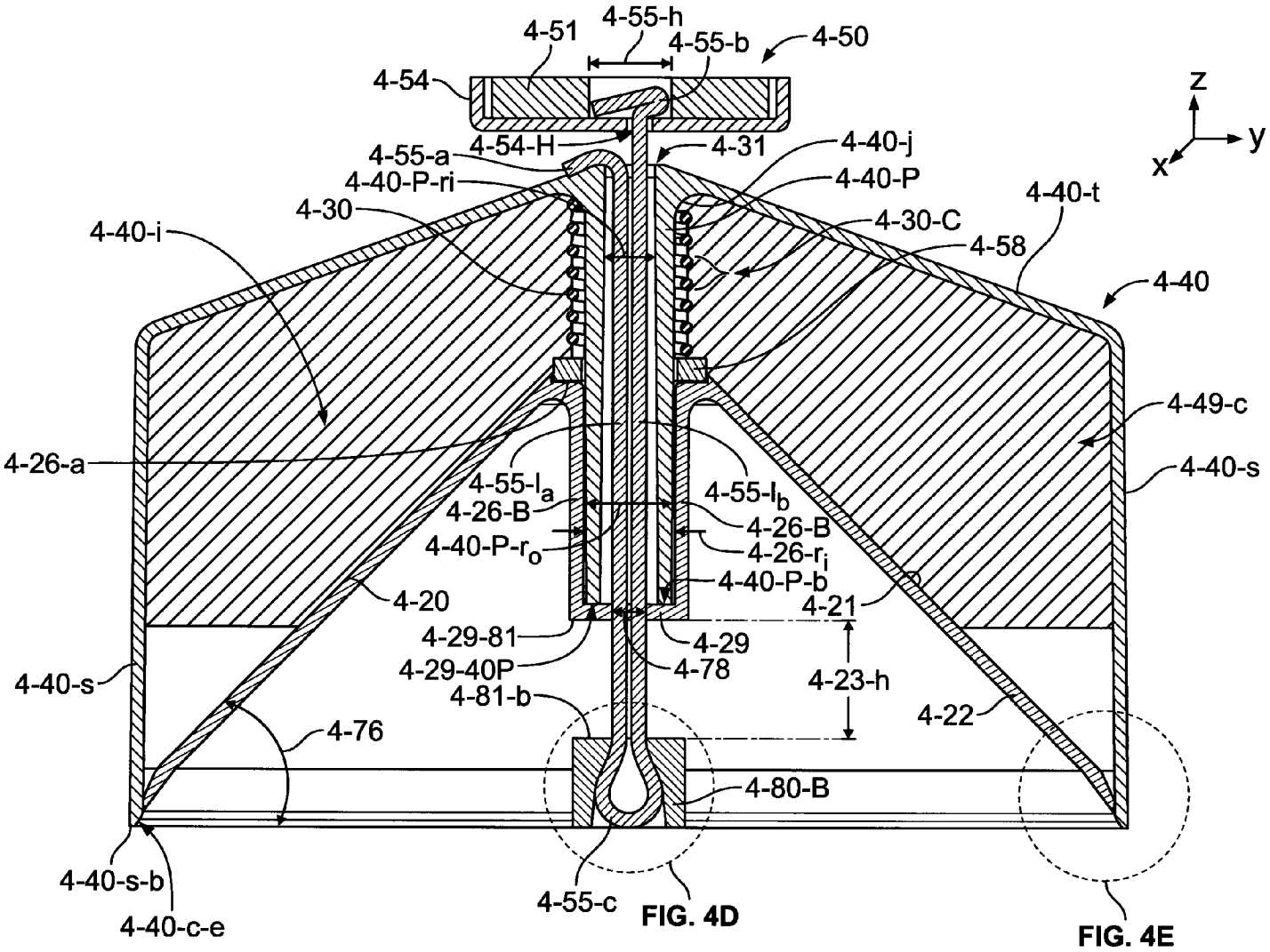
FIG. 4C shows a cross sectional view taken along line B-B of FIG. 4B of a stovetop fire suppressor in a closed state, in accordance with an exemplary embodiment of the present invention.
Figure 4D:
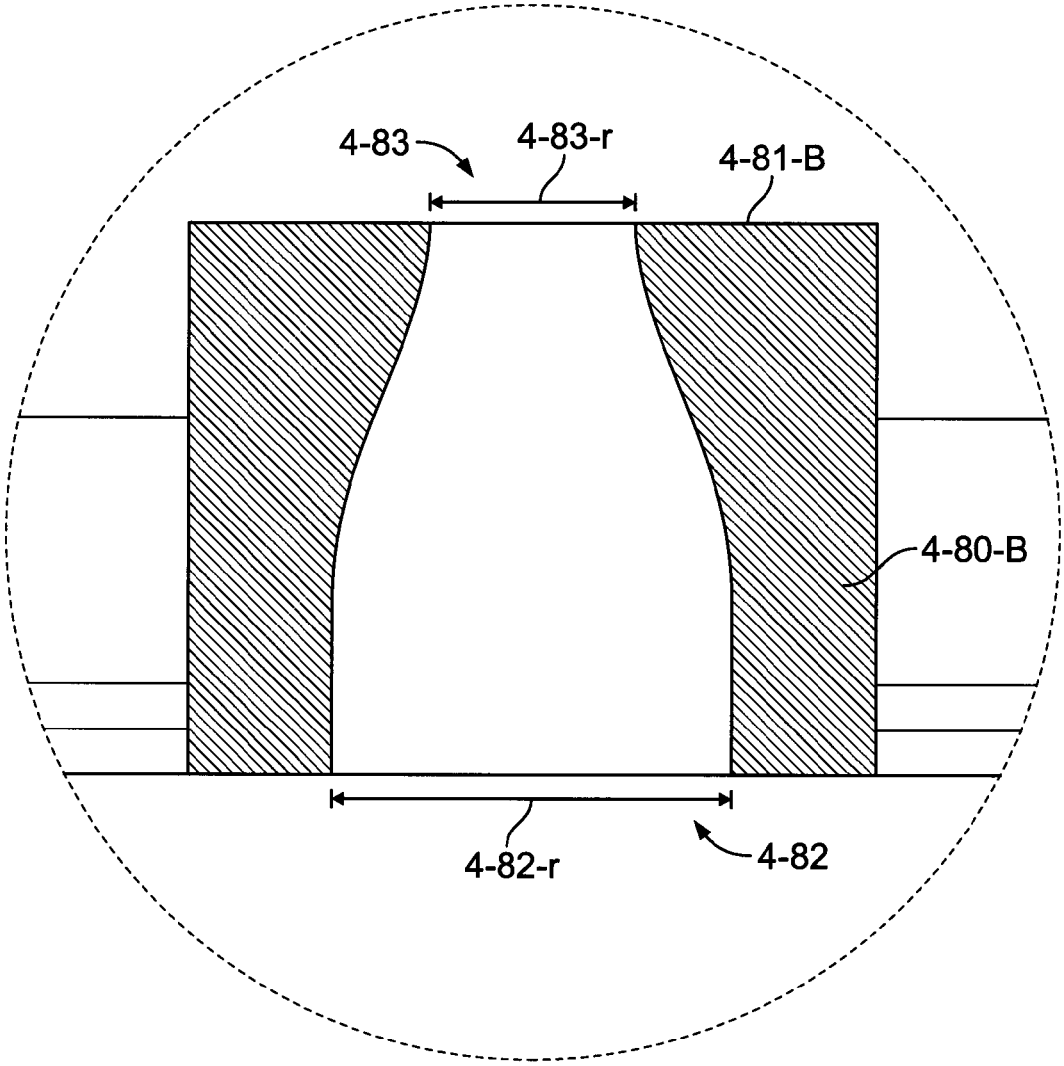
FIG. 4D shows a portion of FIG. 4C in greater detail, in accordance with an exemplary embodiment of the present invention.

FIG. 4B shows a top view of a stovetop fire suppressor, in accordance with an exemplary embodiment of the present invention. The mounting device 4-50 of FIG. 4A is not shown. The bend of cotter pin legs 4-55-*a* and 4-55-*b* are shown at near 90 degrees in the center of the top wall 4-40-*t*. FIG. 4C shows a cross sectional view of a fire suppressor device in accordance with an exemplary embodiment along line B-B in FIG. 4B. And FIG. 4F shows a cross sectional view of a fire suppressor device in accordance with an exemplary embodiment along line A-A in FIG. 4B.

FIG. 4C shows a cross sectional view taken along line B-B of FIG. 4B of a stovetop fire suppressor in a closed state, in accordance with an exemplary embodiment of the present invention. The container or can 4-40 of the stovetop fire suppressor has a top wall 4-40-*t* and a cylindrical side wall 4-40-*s*. As shown in the embodiment of FIG. 4C, the can top wall 4-40-*t* may be slanted with respect to the horizontal plane X-Y. The can has an integral cylindrical hollow post 4-40-P which begins from the top wall 4-40-*t*, is centered with respect to the top wall, and extends down into the can interior 4-40-*i*. The cross sectional view taken across line B-B in FIG. 4B and shown in FIG. 4C, shows device symmetry about a vertical Z axis centered in the fire suppressor. Many elements, such as center post 4-40-P, are symmetrical across line B-B of FIG. 4B, as shown in FIG. 4C. A compression spring 4-30 surrounds the center post 4-40-P. FIG. 4C shows a stovetop fire suppressor in the closed position, in turn, spring 4-30 is in a compressed 4-30-C state. Spring 4-30 extends from a top inner surface of the junction 4-40-*j* between the top wall 4-40-*t* and the integral center post 4-40-P.

FIG. 4C shows a cone shaped bottom lid 4-20 with an inner side 4-21 and an outer side 4-22. Integral to the cone shaped lid 4-20 is a cylindrical center guide 4-26-B. The center guide 4-26-B is centered in the XY plane of the lid and is open at its top. An inner diameter 4-26-*ri* of the center guide 4-26 is greater than an outer diameter of 4-40-P-ro of the center post. The center guide 4-26-B surrounds a bottom portion of center post 4-40-P. A washer seat 4-26-*a* is disposed in a top side of the center guide 4-26-B. A felt washer 4-58 surrounds the center post 4-40-P and is disposed in the washer seat 4-26-*a*. The spring 4-30 extends to washer 4-58. Turning to a bottom of the center guide 4-26-B, a circumferential shoulder 4-29 is formed integral to the side walls of the center guide. The shoulder turns inward reducing the opening diameter 4-78 at the bottom of the center guide 4-26-B across the shoulder 4-29. An inner side 4-29-40P of shoulder 4-29 presses against a bottom edge 4-40-P-b of post 4-40-P when the stove top fire suppressor is in its closed position, as shown, in accordance with an exemplary embodiment.

A fire suppressing agent 4-49-*c* is stored in the can 4-40 interior space 4-40-*i*. Cone lid 4-20 forms an angle 4-76 relative to the horizontal plane X-Y, which, in part, directs flow of the fire suppressing agent upon activation of the fire suppressing device. The interface between the cone lid 4-20 and the can side wall 4-40-*s* is shown in greater detail in FIG. 4E. Referring still to FIG. 4C, the can sidewall 4-40-*s* is chamfered 4-40-*c*-*e* at its bottom edge 4-40-*s*-*b* along an inner circumference of the can 4-40. Extending from an outer side 4-22 of the cone lid to the top wall 4-40-*t* of the can 4-40 is a cotter pin with legs 4-55-*la* and 4-55-*lb*. The curve 4-55-*c* of the cotter pin rests in a pin and bulb base 4-80-B. The legs of the cotter pin 4-55-*la*, 4-55-*lb* extend from the pin curve 4-55-*c* in the pin and bulb base 4-80-B through an opening in the shoulder 4-29 and up through the center post 4-40-P.

The pin and bulb support 4-80 of FIG. 4A is shown in FIG. 4C 4-80-B at a cross sectional view taken along line B-B in FIG. 4B. This view of the pin and bulb support is shown in greater detail in FIG. 4D. Referring to FIG. 4D, in practice the legs 4-55-*la*, 4-55-*lb* are inserted up the bottom opening 4-82 and out the top opening 4-83 of the pin and bulb support 4-80-B. The inner radius of the pin and bulb support 4-80-B tapers from a bottom radius 4-82-*r* to a top radius 4-83-*r*. The bottom radius 4-82-*r* accommodates the curve 4-55-*c*, shown for example in FIG. 4C, of the cotter pin. Referring again to FIG. 4D, top radius 4-83-*r* is too small for the curve 4-55-*c* and permits only the legs 4-55-*la*, 4-55-*lb* to pass through. The inner radius of 4-80 may taper with a cross section near that of the cotter pin's YZ cross section as shown, for example, in FIG. 4C. The pin and bulb support 4-80, shown in FIG. 4A, is further described below with reference to FIG. 4F.

Figure 4E:
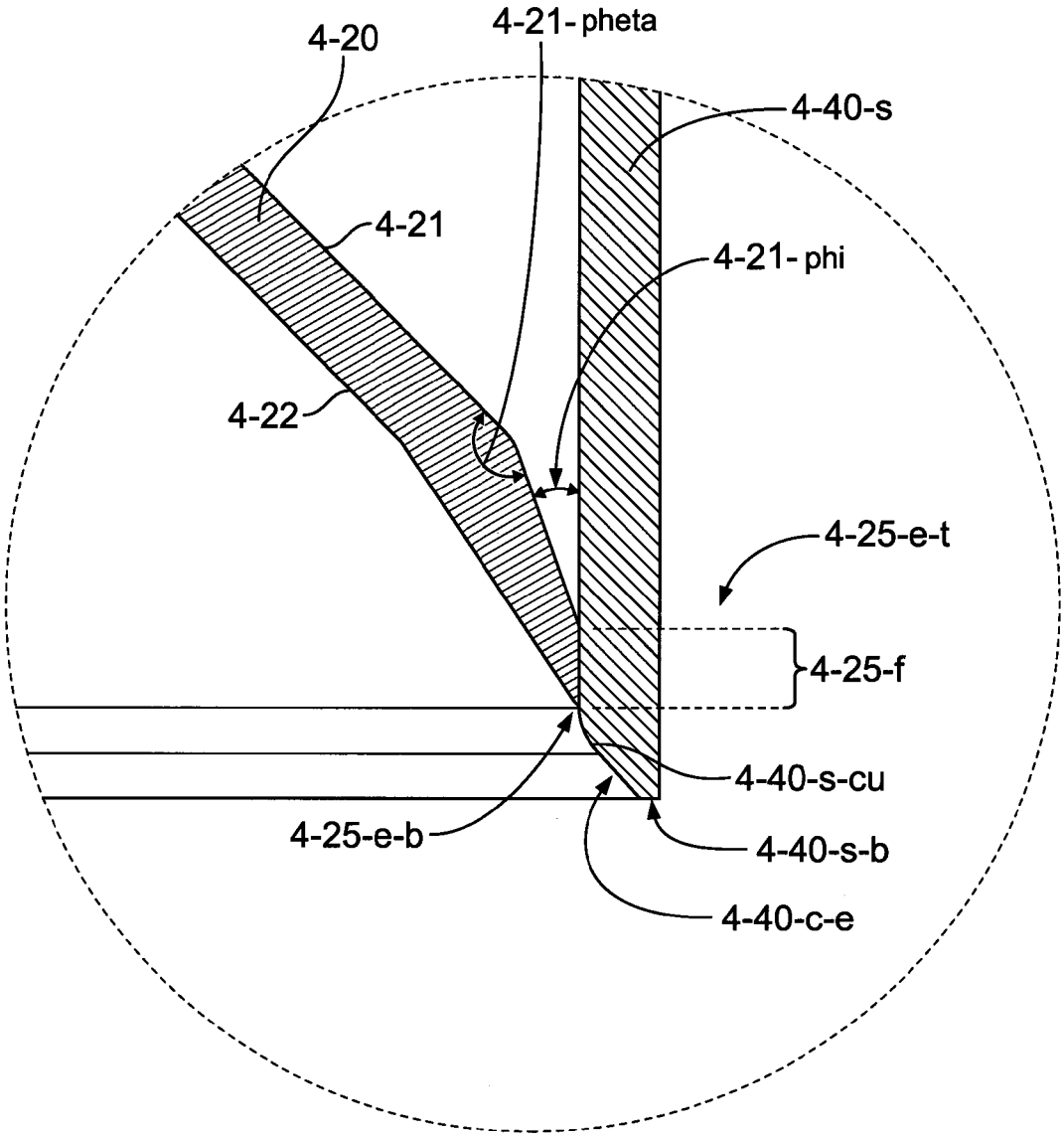
FIG. 4E shows another portion of FIG. 4C in greater detail, in accordance with an exemplary embodiment of the present invention.
Figure 4F:
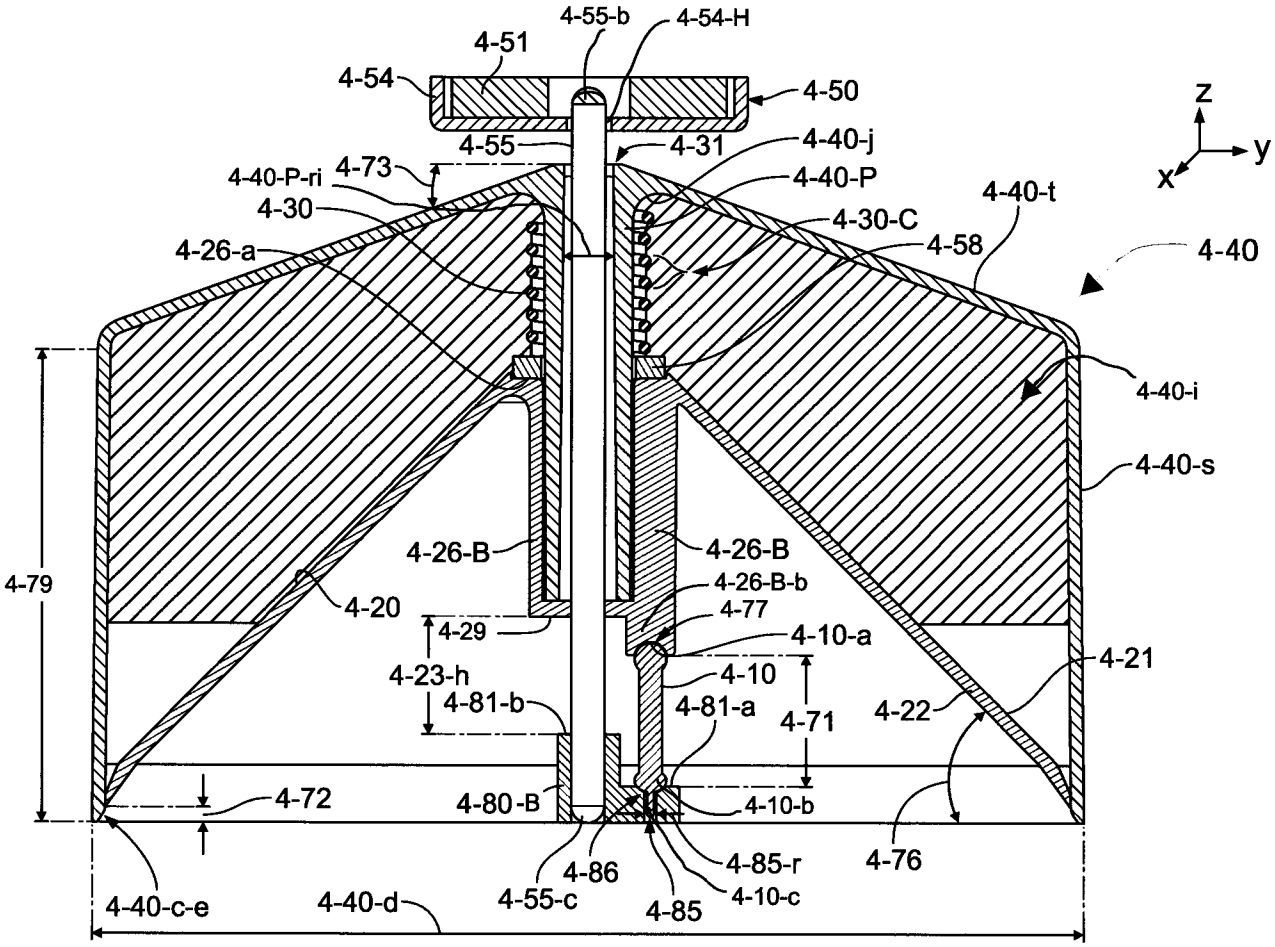
FIG. 4F shows a cross sectional view taken along line A-A of FIG. 4B of a stovetop fire suppressor in a closed inactivated state, in accordance with an exemplary embodiment of the present invention.

FIG. 4E shows the interface between the outer edge of the cone lid 4-20 and the bottom of the can sidewall 4-40-*s* of FIG. 4C in greater detail. Referring to FIG. 4E, in accordance with the exemplary embodiment of FIG. 4E, the bottom edge 4-40-*s*-*b* is chamfered 4-40-*c*-*e* on the inner circumference of the side wall 4-40-*s*. In alternate embodiments, alternate configurations of the bottom of the sidewall may be desired. For example, the configuration of the bottom edge of the sidewall may be rounded, not chamfered, straight, or may come to a point. Towards an outer circumference bottom lid 4-20 may bend 4-21-pheta. The outer edge of the cone lid 4-20 tapers with an angle 4-21-*phi*. The taper is cut to form a vertical face 4-25-*f* of the circumferential edge of the cone lid 4-20 with a top 4-25-*e*-*t* and a bottom 4-25-*e*-*b*. End face 4-25-*f* is juxtaposition the inner sidewall 4-40-*s* when the fire suppressor device is in its closed inactivated state, as shown in FIG. 4E. A vertical Z distance between bottom edge 4-25-*e*-*b* and chamfer 4-40-*c*-*e* may vary across embodiments. The bottom edge of the side wall may be include a curved region 4-40-*cu* above or below a chamfer 4-40-*c*-*e*. Or the bottom edge 4-40-*s*-*b* may be rounded.

FIG. 4F shows a cross sectional view taken along line A-A of FIG. 4B of a stovetop fire suppressor in a closed state, in accordance with an exemplary embodiment of the present invention. The symmetry of many elements in the subject view is carried across from the cross section along line B-B of FIG. 4B, shown in FIG. 4C. For example, elements of the can 4-40 to include top wall 4-40-*t*, sidewall 4-40-*s*, and cylindrical center post 4-40-P are symmetrical across a center Z axis. The spring 4-30 is still shown in its compressed 4-30-C state and extends from a top inner surface of the junction 4-40-*j* between the top wall 4-40-*t* and the integral center post 4-40-P to a felt washer 4-58 disposed in a washer seat 4-26-*a*. The washer seat 4-26-*a* may have an indentation and is disposed in a top side of the center guide 4-26-B. In the subject view, the right side of center guide 4-26-B-b extends beneath shoulder 4-29 and forms an upper bulb rest 4-77. A thermal glass bulb is lodged between an upper bulb support 4-77 and a lower bulb support 4-86. The upper bulb support is configured to accommodate an upper thermal glass bulb end 4-10-*a*. The upper bulb support 4-77 is integral to the center guide 4-26-B. Center guide 4-26-B is not symmetrical about a center axis, as seen across FIGS. 4C and 4F.

The view of FIG. 4F shows the second through hole 4-85 in the lower pin and bulb support 4-80-B. An inner radius 4-85-*r* of the bulb through hole 4-85 accommodates an outer diameter of the thermal glass bulb's lower extension 4-10-*c*. The lower bulb support has an indent 4-86 that holds the lower end 4-10-*b* of the thermal glass bulb 4-10. In accordance with an exemplary embodiment, the thermal glass bulb may be rated at 175 degrees Fahrenheit with have a height of 16 millimeters. A G5 THERMO-BULB (Job GMBH, Ahrensburg,Germany) can be used in accordance with embodiments of the present invention and this bulb has the UL Mark.

The curve of the cotter pin 4-55-*c* is shown within the lower pin and bulb support 4-80-B. The pin extends up through the opening of the center guide shoulder 4-29 and through the center post 4-40-P, being narrower in its widest profile than the inner radius 4-40-P-ri of the center post 4-40-P. The longer leg of the cotter pin 4-55 passes through an opening 4-54-H of the magnet housing 4-54 and bends 4-55-*b* to secure the magnet housing to the fire suppressor device. The bend 4-55-*b* fits within a center of magnet 4-51 of the mounting device 4-50.

In the exemplary embodiment of FIG. 4F, the shoulder 4-29 drops to rest upon catching surface 4-81-*b* when the fire suppressor activates. In accordance with an exemplary embodiment of the present invention, the corresponding drop height 4-23-*h* may be one-half inch. The height 4-71 from a bottom surface of 4-26-B at the bulb support 4-77 to a top surface 4-81-*a* of the lower pin and bulb support 4-80 on the bulb side may be less than the drop height. The cone lid 4-20 view is very similar across the cross sections of FIGS. 4C and 4F. The inner side 4-21 of the cone lid 4-20 faces the can 4-40 interior cavity 4-49-*i*. An outer side 4-22 at the outer circumference of the cone lid 4-20 fits very near an inner chamfer 4-40-*c*-*e* of the sidewall 4-40-*s* at its bottom end 4-40-*s*-*b*, 4-40-*s*-*b* shown in FIG. 4C. In accordance with an exemplary embodiment the chamfer height 4-72 may be near 0.05 inches. In alternate embodiments, the chamfer may be steeper or shallower, or the sidewall 4-40-*s* may be straight.

The angle of decline 4-73 of top wall 4-40-*t* is shown with respect to the horizontal XY plane. In accordance with an exemplary embodiment, the angle 4-73 may be 20 degrees. In accordance with alternate embodiments, the angle may be more than 20 degrees, less than 20 degrees, or zero. In accordance with an exemplary embodiment the height 4-79 of the fire suppressor device from its sidewall bottom edge 4-40-*s*-*b* to its highest point on the top wall 4-40-*t* may be 3 inches. In accordance with alternate embodiments, lower or higher device heights may be desired. An exemplary diameter 4-40-*d* of the can across its outer side walls is 4.5 inches. The cone angle can 4-76, as measured from a bottom horizontal, in accordance with an exemplary embodiment, is 45 degrees. The cone angle may also vary across embodiments. The angle may vary with the diameter of the container. The angle may also vary in accordance with a height 4-79 of the container side wall.

Referring again to FIG. 4C, the top 4-55-*a* of the short leg 4-55-*la* of the cotter pin exits out of top opening 4-31 of the center post 4-40-P and bends 4-55-*b* to secure the pin to the mounting assembly 4-50. The bend 4-55-*b* fits within the opening in the magnet 4-55-*h* but extends past the opening 4-54-H in the magnet housing 4-54. In accordance with an exemplary embodiment shown in FIGS. 4C and 4F, opening 4-54-H is symmetrical across respective orthogonal cross sectional views. Referring to FIG. 4F, the wider side of pin 4-55 passes up through the center post 4-40-P, being narrower than the inner radius 4-40-P-ri of the center post 4-40-P.

Figure 5A:
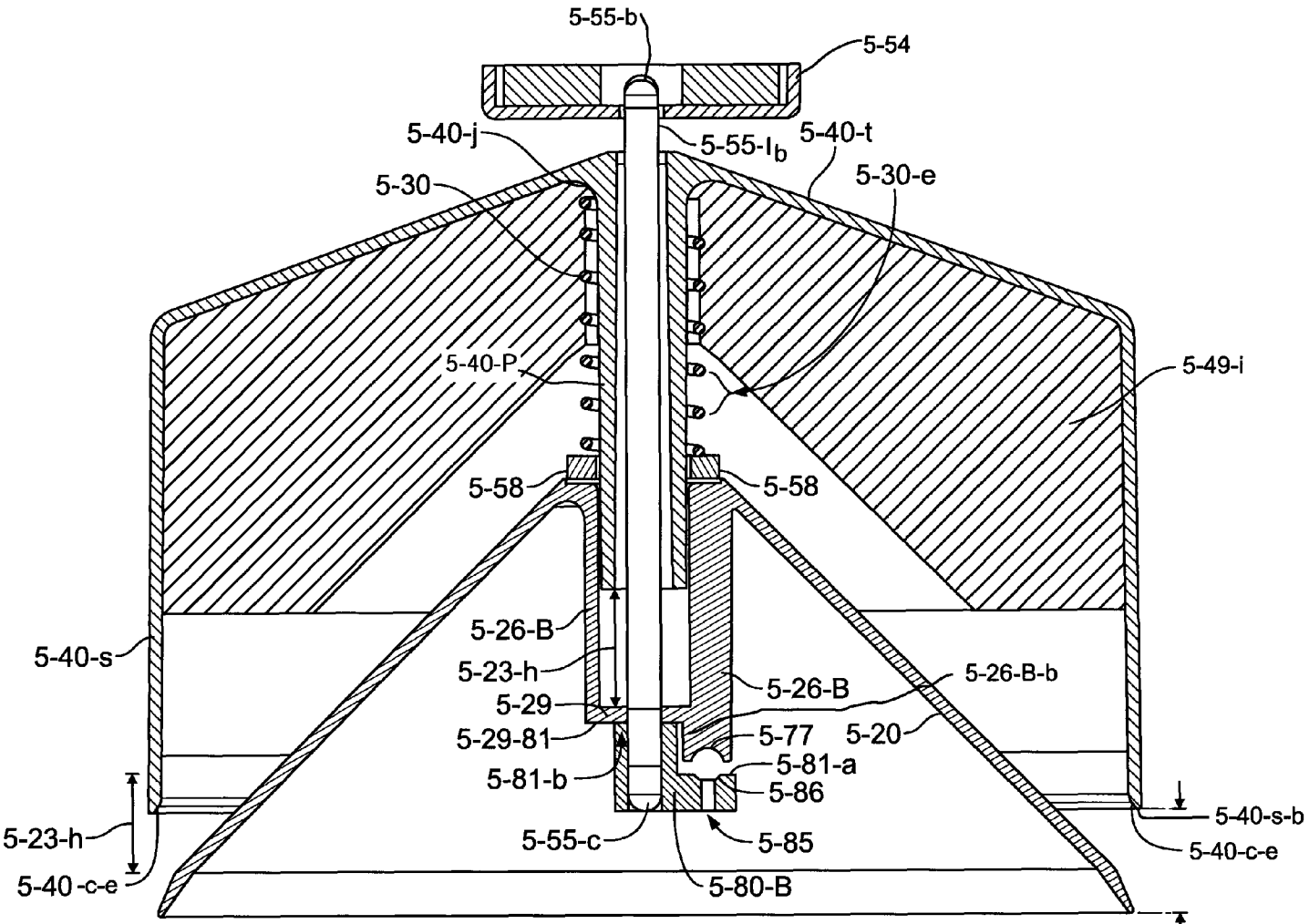
FIG. 5A shows a cross sectional view taken along line B-B of FIG. 4B of a stovetop fire suppressor in an open activated state, in accordance with an exemplary embodiment of the present invention.

FIG. 5A shows a cross sectional view taken along line A-A of FIG. 4B of a stovetop fire suppressor in an open activated state, in accordance with an exemplary embodiment of the present invention. Here the lid 5-20 has separated from the cylindrical sidewall 5-40-*s*. More particularly, lid 5-20 has dropped below a side wall bottom end 5-40-*s*-*b* by a drop height of 5-23-*h*. Shoulder 5-29 has dropped and lower surface 5-29-81 rests upon catching surface 5-81-*b* when the fire suppressor activated. A drop height 5-23-*h* is shown from a bottom of center post 5-40-P and shoulder 5-29 of center guide 5-26-B. Spring 5-30 is shown in its extended, less compressed, state 5-30-*e*. The spring 5-30 extends from a top inner surface of the junction 5-40-*j* between the top wall 5-40-*t* and the integral center post 5-40-P to felt washer 5-58. The felt washer is disposed atop center guide 5-26-B. Center guide 5-26-B is integral to the cone shaped bottom lid 5-20. In the open activated state of FIG. 5A, the thermal glass bulb, 4-10 shown in FIG. 4F, has broken with heat activation and the compressed spring, 4-30-C shown in FIG. 4F, extends 5-30-*e* to lower the cone shaped lid 5-20 into the position of FIG. 5A. In accordance with an exemplary embodiment, the spring 5-30 may be a helical compression spring. It may have a free length of 1.5 inches and a load rate of 6.0 lbs/inch. The spring may be zinc plated steel and have a wire diameter of 0.05 inches.

The right side 5-26-B-b of center guide 5-26-B extends beneath shoulder 5-29 and forms an upper bulb rest 5-77. In the exemplary embodiment of FIG. 5A, a bottom of top bulb support 5-77 is spaced above a top 5-81-*a* of the lower pin and bulb support 5-80-B. The upper 5-77 bulb support, the lower 5-86 bulb support, and the bulb through hole 5-85 are shown empty. When the lid 5-20 drops down creating radial opening 5-29-*r*, the fire suppressing agent, not shown, will flow out of the can cavity 5-49-*i*. The sidewalls chamfered end 5-40-*c*-*e* and the sidewall bottom end 5-40-*s*-*b* are shown in more detail in FIG. 4E. FIGS. 5A and 4E illustrate exemplary embodiments. Referring to FIG. 4E, alternate embodiments may have alternate configurations to include, but not limited to, changes in the chamfer 4-40-*c*-*e*, changes in the curve edge 4-40-*cu*, or the end face 4-25-*f* of the lid 4-20.

As in FIG. 4F, 5-55-*lb* goes through an opening in the magnet housing 5-54 and bends 5-55-*b* to secure the fire suppressing device to the magnet housing 5-54. The curve 5-55-*c* of the cotter pin is shown in pin and bulb support 5-80-B.

Figure 5B:
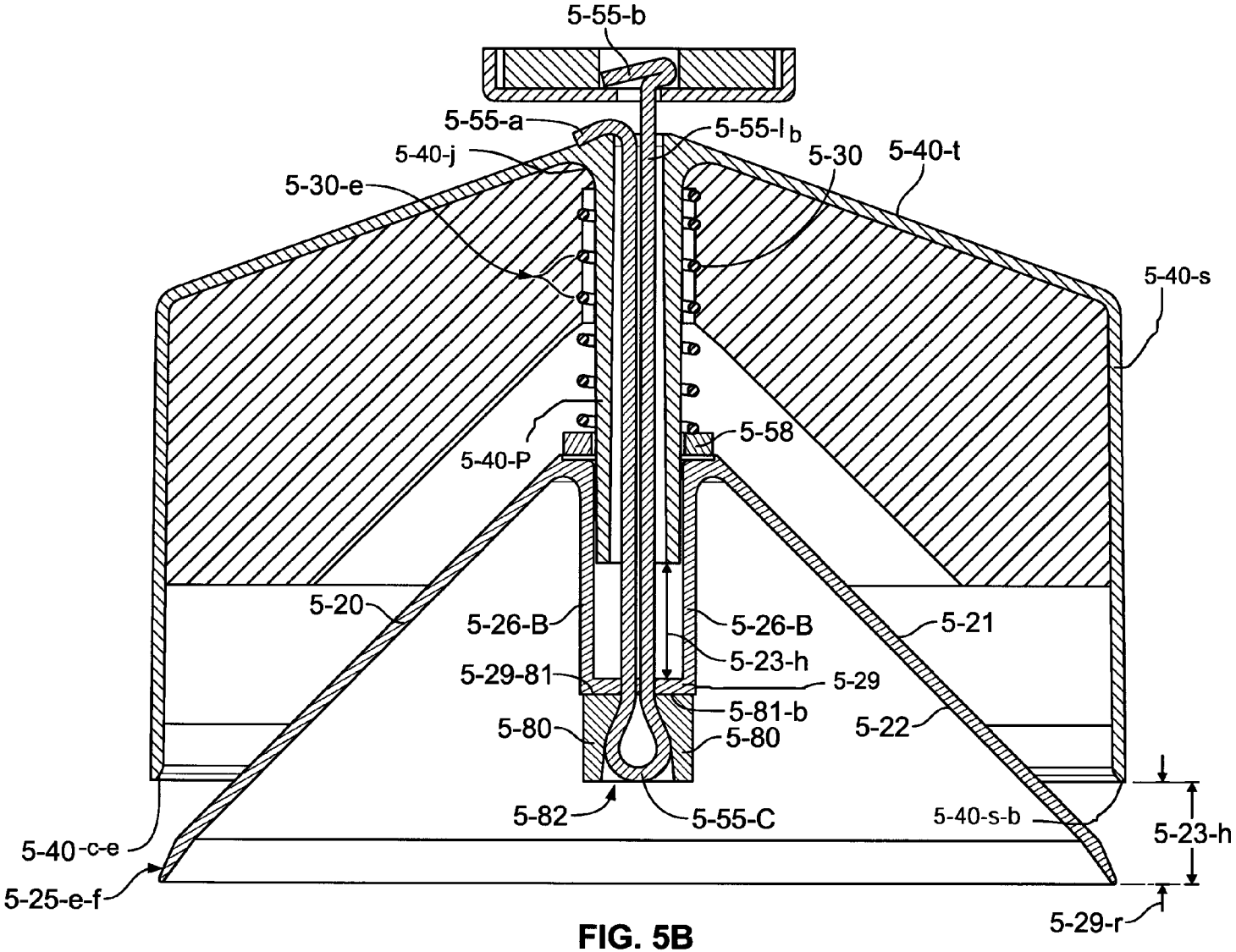
FIG. 5B shows a cross sectional view taken along line A-A of FIG. 4B of a stovetop fire suppressor in an open activated state, in accordance with an exemplary embodiment of the present invention.

FIG. 5B shows a cross sectional view taken along line B-B of FIG. 4B of a stovetop fire suppressor in an open activated state, in accordance with an exemplary embodiment of the present invention. The lid 5-20 has dropped below a side wall bottom end 5-40-*s*-*b* by a drop height of 5-23-*h*. Shoulder 5-29 has dropped to rest lower surface 5-29-81 upon catching surface 5-81-*b* of the lower pin and bulb support 5-81-*b* when the fire suppressor activated. Drop height 5-23-*h* is also shown from a bottom of center post 5-40-P and shoulder 5-29 of center guide 5-26-B. Spring 5-30 is shown in its extended, less compressed, state 5-30-*e*. The spring 5-30 extends from a top inner surface of the junction 5-40-*j* between the top wall 5-40-*t* and the integral center post 5-40-P to felt washer 5-58. The felt washer is disposed atop center guide 5-26-B. Center guide 5-26-B is integral to the cone shaped bottom lid 5-20, which has an inner side 5-21 and an outer side 5-22. The bend of cotter pin leg 5-55-*a* is shown bent at greater than 90 degrees upon the center of the top wall 5-40-*t*. Cotter pin leg 5-55-*lb* exits out of top opening of the center post 5-40-P and bends 5-55-*b* to secure the pin to the mounting assembly.

The thermal glass bulb support, shown for example in FIG. 5A, is not part of the view along line B-B, shown in FIG. 5B. In practice, the curve of cotter pin 5-55-*c* fits into opening 5-82 of the pin and bulb support 5-80. The loop of the cotter pin 5-55-*c* nests within the lower pin and bulb support 5-80 and is described in greater detail with reference to FIG. 4D. The can sidewalls 5-40-*s* chamfered end 5-40-*c*-*e* and an end face 5-25-*e*-*f* is shown in FIG. 5B. The fire suppressing agent, not shown, will flow out of the radial opening 5-29-*r* when the cone shaped bottom lid 5-20 lowers.

Figure 6A:
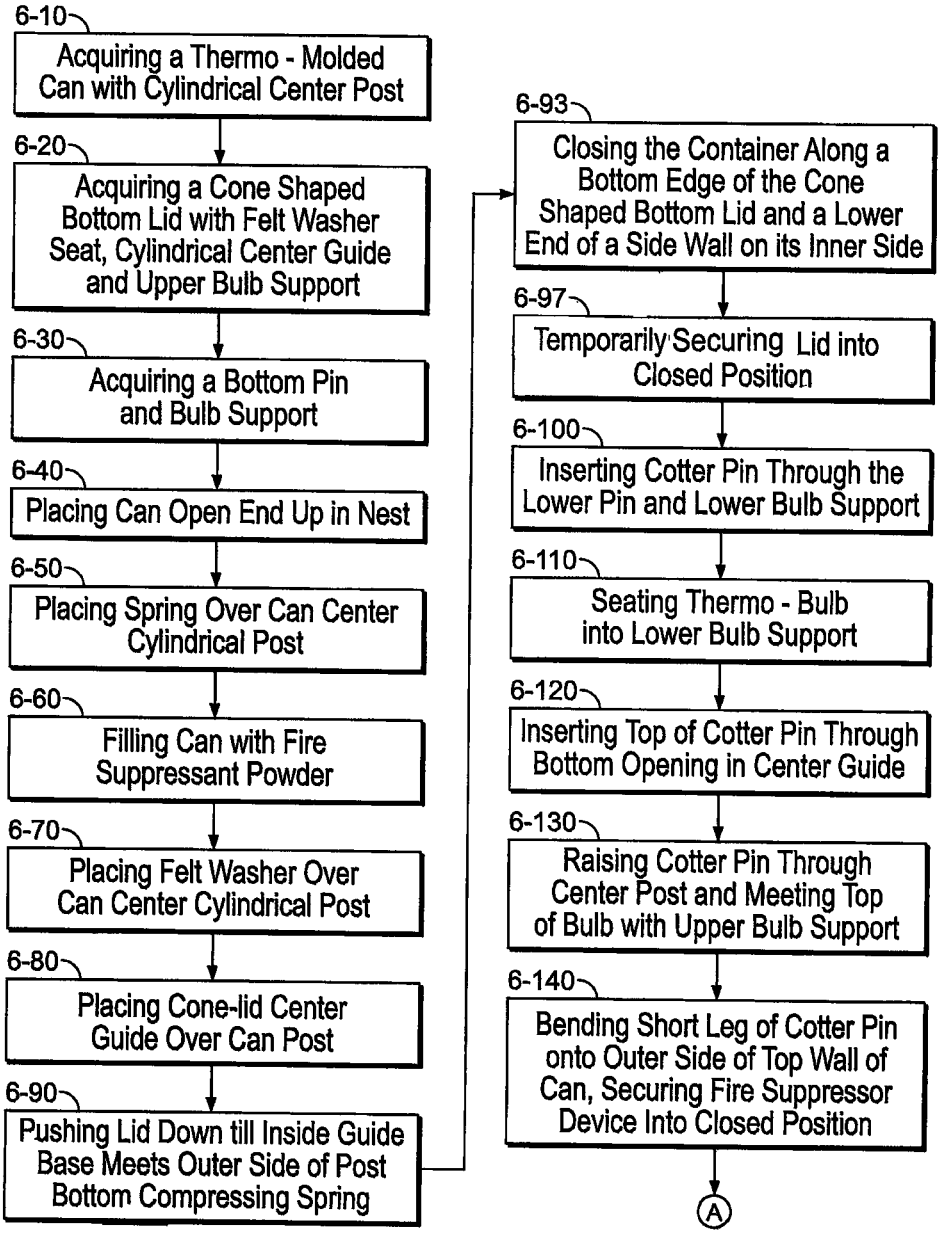
FIGS. 6A and 6B show an exemplary method of assembling an automatic stovetop fire suppressor with fire suppressing agent, and the assembly further including a mounting housing, respectively, in accordance with an exemplary embodiment of the present invention.
Figure 6B:
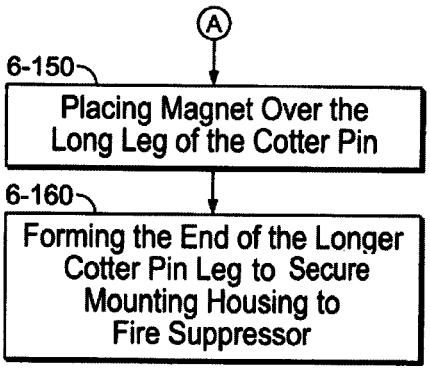

FIGS. 6A and 6B show an exemplary method of assembling a fire suppressing agent in an automatic stovetop fire suppressor, and the assembly further including a mounting housing, respectively, in accordance with an exemplary embodiment of the present invention. A method of assembling an automatic stovetop fire suppressor, in accordance with an exemplary embodiment includes: acquiring a thermo-molded can with cylindrical center post 6-10; acquiring a cone-shaped bottom lid with felt washer seat, cylindrical center guide, and upper bulb support 6-20; acquiring a bottom pin and bulb support 6-30; placing can open end up in nest 6-40; placing spring over can center cylindrical post 6-50; filling container with a fire suppressing agent 6-60; placing felt washer over can cylindrical center post 6-70; placing cone-lid center guide over can post 6-80; pushing lid down till inside guide base meets outer side of post bottom compressing spring 6-90; closing the container along a bottom edge of the cone shaped bottom lid and a lower end of a side wall on its inner side 6-93; temporarily securing lid into closed position 6-97; inserting cotter pin through the lower pin and lower bulb support 6-100; seating thermal glass bulb into lower bulb support 6-110; inserting top of cotter pin through bottom opening of center guide 6-120; raising cotter pin through center post and meeting top of bulb with upper bulb support 6-130; bending short leg of cotter pin onto outer side of top wall of can, securing fire suppressor device into closed position 6-140. In alternate embodiments, the lower pin and bulb support may be one integral piece, or a lower bulb support and a lower pin support may be respective parts. Further, respective parts may be affixed together. An exemplary integral pin and bulb support is shown in FIG. 4F. In accordance with another exemplary method of assembly embodiment, shown in FIG. 6B, the method further includes: placing housed magnet over the long leg of the cotter pin 6-150; and forming the end of the longer cotter pin leg securing mounting housing to fire suppressor 6-160.

Figure 7:
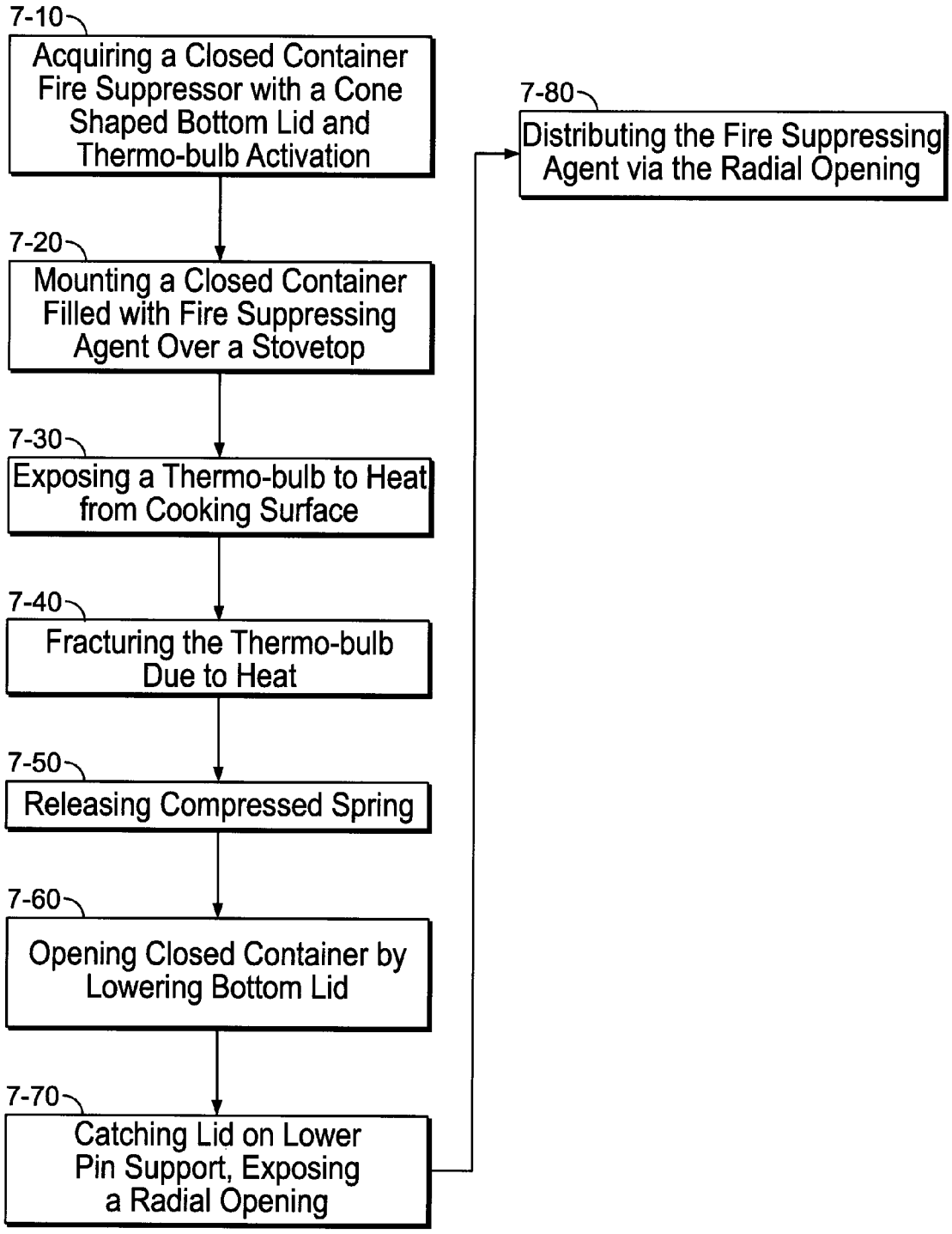
FIG. 7 shows an exemplary method of distributing a fire suppressing agent in an automatic stovetop fire suppressor, in accordance with an exemplary method of the present invention.

FIG. 7 shows an exemplary method of distributing a fire suppressing agent in an automatic stovetop fire suppressor, in accordance with the present invention. A method of distributing a fire suppressing agent, in accordance with an exemplary embodiment includes: acquiring a closed container fire suppressor with cone shaped bottom lid 7-10; mounting the closed container filled with fire suppressing agent over a stovetop 7-20; exposing a thermal glass bulb to heat from a cooking surface 7-30; fracturing the thermal glass bulb due to heat 7-40; releasing compressed spring 7-50; opening closed container by lowering a bottom lid 7-60; catching lid on lower pin support, exposing a radial opening 7-70; and distributing the fire suppressing agent via the radial opening 7-80. Each of these distributing method elements is exemplary. For example, the catching interfaces between the lid and a lower support can vary. In accordance with an alternate embodiment, the center guide, which is integral to the lid, catches on a lower shaft and bulb support. In still an alternate embodiment, a key on the center guide catches in a slot in the shaft and bulb support.

In accordance with an exemplary embodiment of the present invention, a container diameter of four inches and a cone angle of 45 degrees has yielded a fire suppressing agent distribution rate and pattern which extinguishes a burning cooking oil fire with minimal or no oil splatter. Embodiments of the present invention may be mounted in a micro-hood or vent hood stovetop environment. The weight and volume of fire suppressing agent contained in the container of embodiments of the present invention may be very near that of conventional automatic stovetop fire suppressors.

Figure 8:
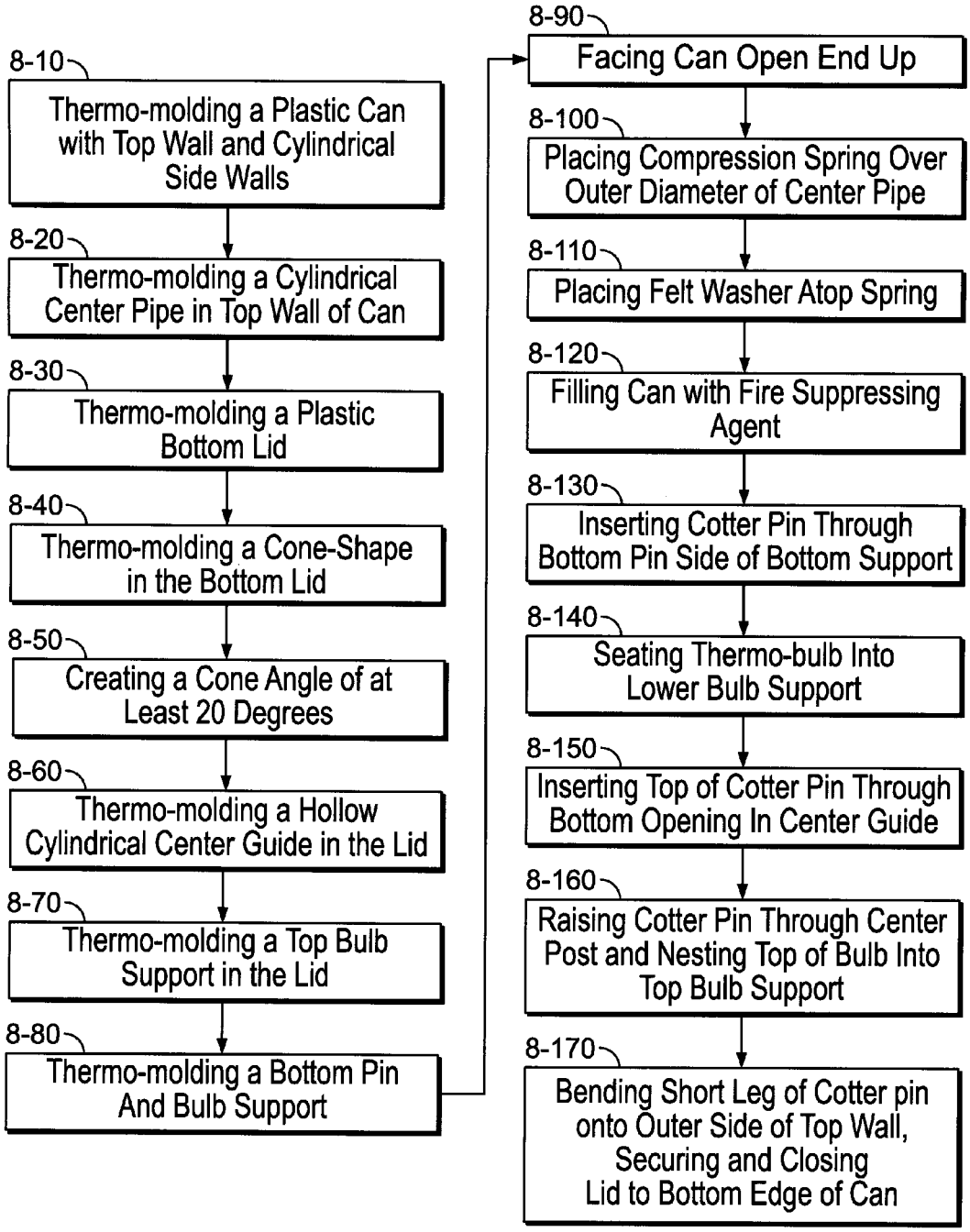
FIG. 8 shows an exemplary method of manufacturing an automatic stovetop fire suppressor, in accordance with an exemplary embodiment of the present invention.

FIG. 8 shows an exemplary method of manufacturing an automatic stovetop fire suppressor, in accordance with the present invention. The manufacturing method includes: thermo-molding a plastic can with top wall and cylindrical side walls 8-10; and thermo-molding a cylindrical center pipe, a center post with hollow center, in a top wall of can 8-20. In accordance with the exemplary embodiment shown, for example, in FIG. 4C, the cylindrical center post is integral to the top wall. Referring again to FIG. 8, the manufacture method further includes: thermo-molding a plastic bottom lid 8-30; thermo-molding a cone-shape in the bottom lid 8-40; creating a cone angle of at least 20 degrees 8-50; thermo-molding a hollow cylindrical center guide in the lid 8-60; thermo-molding a top bulb support in the lid 8-70; thermo-molding a bottom pin and bulb support 8-80; facing can open end up 8-90; placing compression spring over outer diameter of center pipe 8-100; placing felt washer atop spring 8-110; and filling can with fire suppressing agent 8-120. The manufacturing method further includes inserting cotter pin through bottom pin side of bottom support 8-130; seating thermal glass bulb into lower bulb support 8-140; inserting top of cotter pin through bottom opening in center guide 8-150; raising cotter pin through center post and nesting top of bulb into top bulb support 8-160; bending short leg of cotter pin onto outer side of top wall, securing and closing lid to bottom edge of can 8-170. In an alternate exemplary embodiment the manufacturing method may include securing the long leg of the cotter pin to a magnet housing.

Figure 9A:
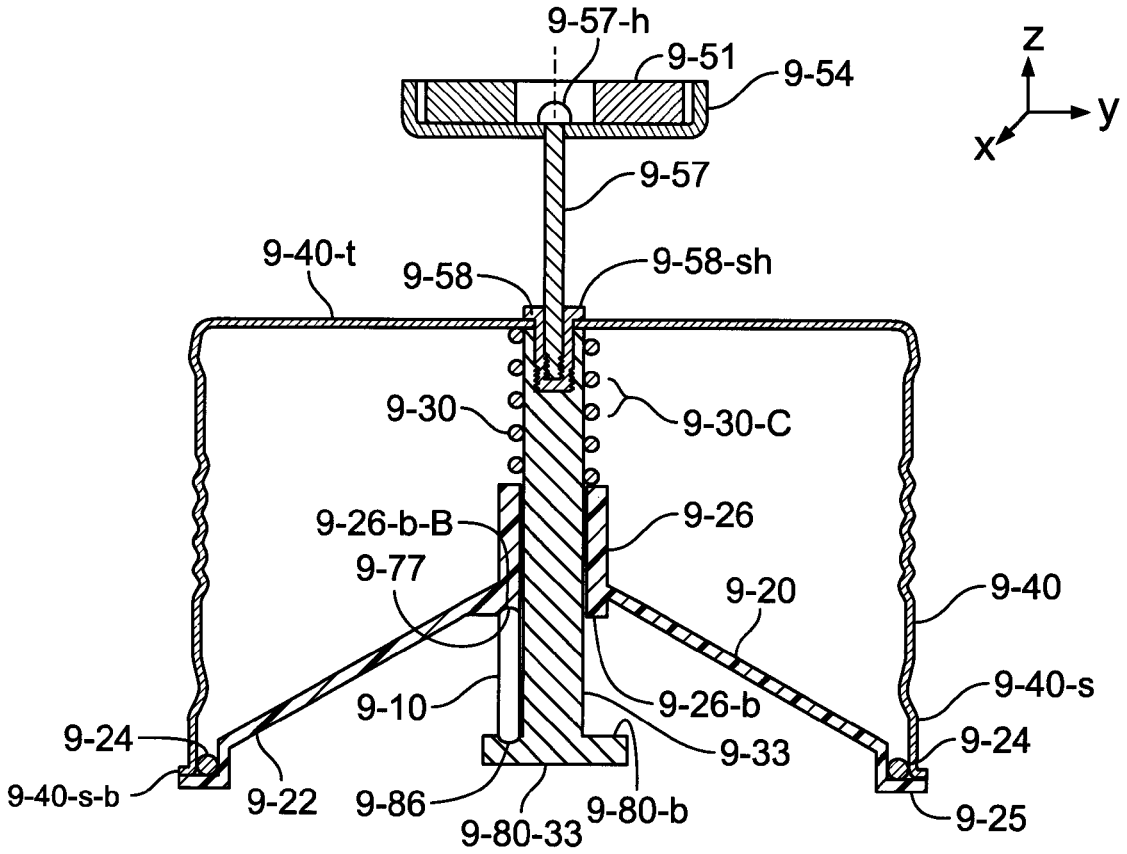
FIG. 9A shows a cross section along axial center of a stovetop fire suppressor that uses an aluminum can in a closed state, in accordance with an exemplary embodiment of the present invention.

FIG. 9A shows a cross section along axial center of a stovetop fire suppressor, that uses an aluminum can in a closed state, in accordance with an exemplary embodiment of the present invention. In accordance with an exemplary embodiment, the can 9-40 may be an off the shelf can with a 4.0 inch diameter opening across its cylindrical sidewalls 9-40-*s*. A screw head 9-57-*h* fits within a center through hole of magnet 9-51. A screw head 9-57-*h* has an outer diameter greater than an opening in magnet housing 9-54. The screw shaft 9-57 extends through the magnet housing 9-54 and mates with internal threads in a threaded insert 9-58. The insert 9-58 secures center post 9-33 to a top wall 9-40-*t* of the can 9-40. When assembled, top wall 9-40-*t* is sandwiched between a shoulder 9-58-*sh* of the insert 9-58 and a top of the center post 9-33. This interface is shown in greater detail in FIG. 9C.

Center post 9-33 may be made of thermo-molded plastic. The center post 9-33 extends from the top wall 9-40-*t* to beneath an outer bottom lid 9-22, forming at integral a bottom ledge 9-80-33 at its opposite end. The spring 9-30 encircles the center post 9-33 and extends from an inner side of the top wall 9-40-*t* to a top of center guide 9-26. Center guide 9-26 is integral to cone shaped bottom lid 9-20. The center guide 9-26 has a lower end 9-26-*b* and an upper bulb support 9-26-*b*-B, which both extend beneath an outer side 9-22 of lid 9-20 near the lid's center. The cone shaped bottom lid has a channel 9-25 along its outer circumference. A seal 9-24, such as an o-ring, fits into the channel and seals against a bottom of the cylindrical side wall 9-40-*s*-*b* when the device is its closed inactivated state, as shown in FIG. 9A. Thermal glass bulb 9-10 seats between a lower bulb support 9-86 and an upper bulb support 9-26-*b*-B and holds the spring 9-30 in its compressed state 9-30-C.

Figure 9B:
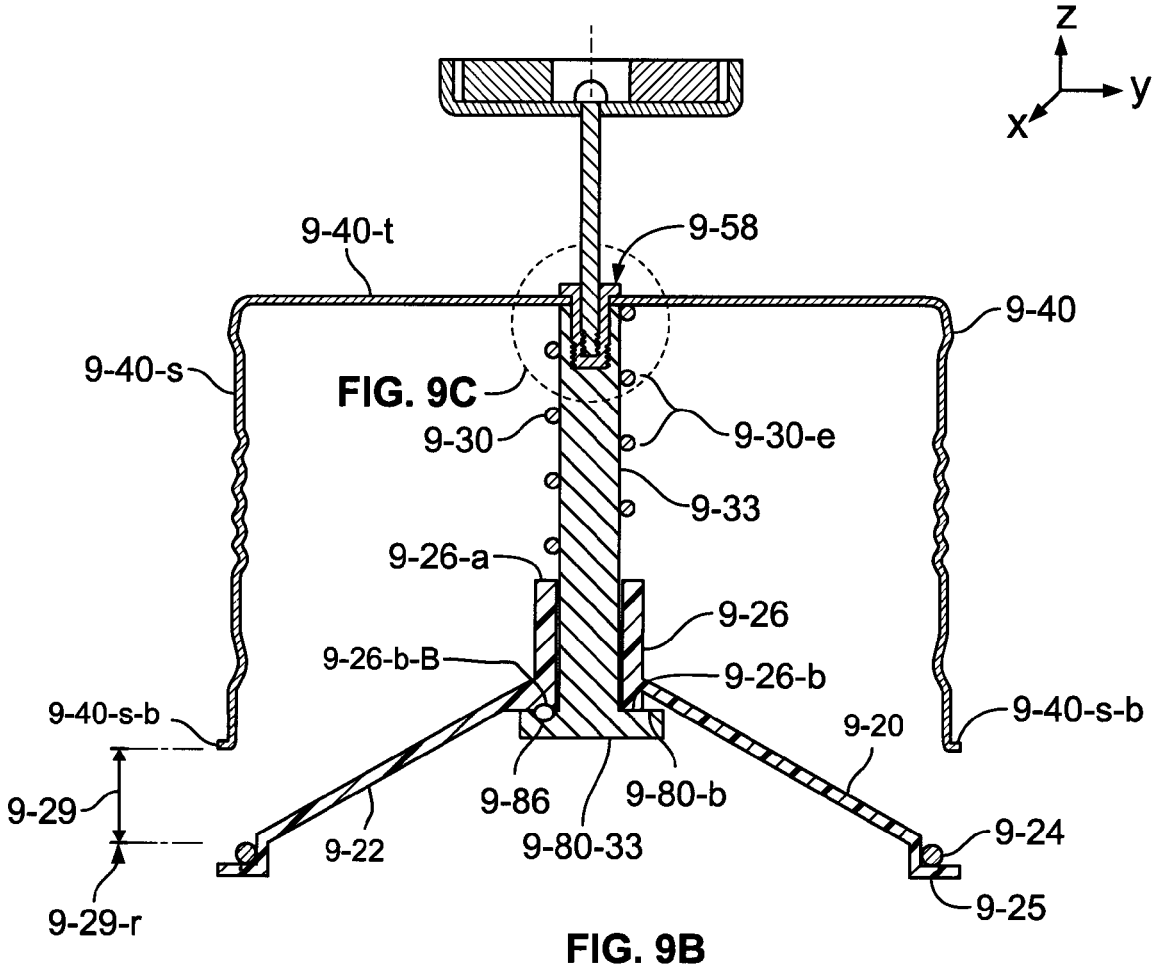
FIG. 9B shows a cross section along axial center of a stovetop fire suppressor that uses an aluminum can in an open activated state, in accordance with an exemplary embodiment of the present invention.

FIG. 9B shows a cross section along axial center of a stovetop fire suppressor that uses an aluminum can in an open activated state, in accordance with an exemplary embodiment of the present invention. In contrast to the embodiment shown in FIGS. 4A-4F, an aluminum can is used to form the cylindrical sidewalls and the top wall of the fire suppressor device. The insert 9-58 interface is shown in greater detail in FIG. 9C. The thermal glass bulb 9-10, shown in FIG. 9A, is now missing and the center guide 9-26 has lowered on center post 9-33. The spring 9-30 is in an extended state 9-30-*e*, extending from a top wall 9-40-*t* to a top surface 9-26-*a* of the center guide 9-26. A bottom 9-26-*b* of the center guide 9-26 lowers to touch a top 9-80-*b* of the integral bottom ledge 9-80-33 of the center post 9-33. In its activated state, upper bulb support 9-26-*b*-B meets lower bulb support 9-86. Thermal glass bulb 9-10 has fractured and is not shown in FIG. 9B.

The seal 9-24 across the channel of the lid 9-25 and can sidewall bottom 9-40-*s*-*b* breaks and the lid 9-20 lowers to expose a radial opening 9-29-*r* of height 9-29. A fire suppressing agent, powder-like and not shown, will gradually flow out of the radial opening 9-29-*r*.

The configuration of the sidewall bottom edge 9-40-*s*-*b* is exemplary and may vary across alternate embodiments. Similarly, the channel 9-25 and seal 9-24 can vary across embodiments as necessary. The stored energy of the compressed spring breaks the seal between the side wall and the bottom lid when the thermal glass bulb breaks and the lid is lowered by the spring.

Figure 9C:
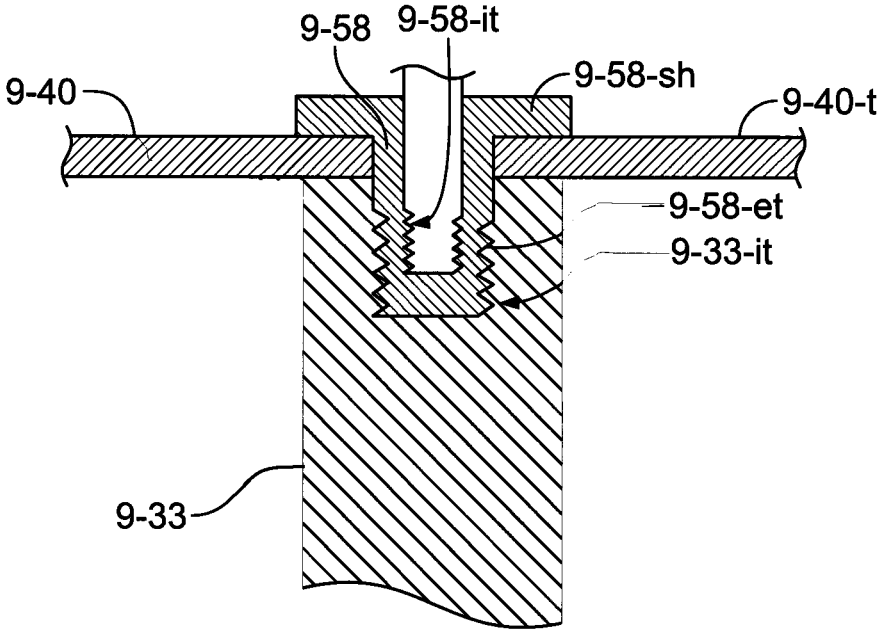
FIG. 9C shows a portion of FIG. 9B in greater detail, in accordance with an exemplary embodiment of the present invention.

FIG. 9C shows a portion of FIG. 9B in greater detail, in accordance with an exemplary embodiment of the present invention. More particularly, FIG. 9C shows a cross section of the interface around a threaded insert, in accordance with an exemplary embodiment of the present invention. Threaded insert 9-58 passes through a top hole in the top wall 9-40-*t* of the can 9-40, shown for example in FIG. 9B. The threaded insert 9-58 secures the center post 9-33 to the top 9-40-*t* of the can 9-40. In accordance with the exemplary embodiment shown in FIGS. 9B and 9C, internal threads 9-33-*it* in the center post 9-33 mate with external threads 9-58-*et* on the insert. In accordance with an exemplary embodiment the insert 9-58 is commercially available. In accordance with an exemplary embodiment, the threaded insert 9-58 may also have internal threads 9-58-*it* for mating to a screw 9-57, shown for example in FIGS. 9A and 9B. The screw may form part of a mounting assembly for a vent hood stovetop environment. In still alternate embodiments, internal threads of the threaded insert may mate to a custom pin for mounting in a micro-hood environment. In accordance with an exemplary embodiment of the present invention, the threaded insert has a machined shoulder 9-58-*sh* to secure it onto the top wall 9-40-*t* of the can.

Figure 9D:
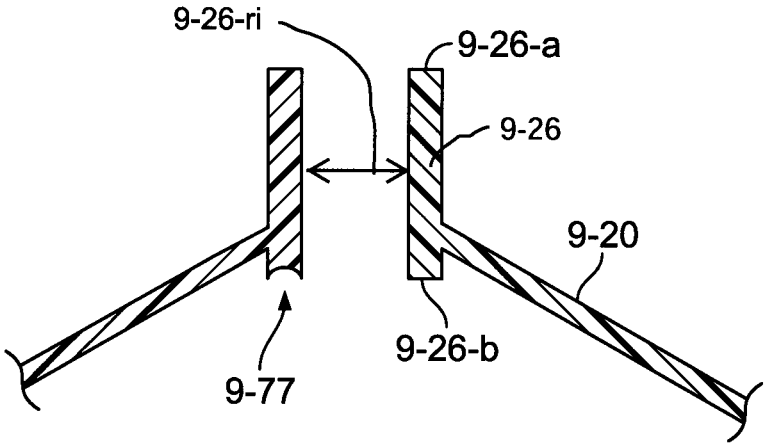
FIG. 9D shows a cross sectional view along axial center of a upper portion of a center guide bushing in an exemplary fire suppressor device in accordance with the present invention.

FIG. 9D shows a cross sectional view along axial center of an upper portion of a center guide bushing in an exemplary fire suppressor device in accordance with the present invention. The center guide 9-26 has a bottom extension 9-26-*b* that will rest on a bottom edge of post 9-33, shown in FIG. 9E, when the fire suppressor device activates. A top bulb support 9-77 is disposed in a lower extension of the center guide. An inner radius 9-26-*ri* of the center guide 9-26 is slight larger than an outer radius of the center post, shown in FIG. 9E.

Figure 9E:
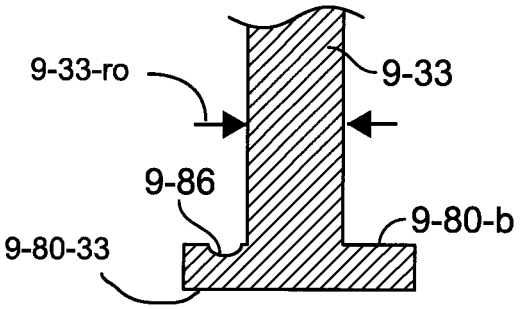
FIG. 9E shows a cross sectional view along axial center of a bottom portion of a center post in an exemplary fire suppressor device in accordance with the present invention.

FIG. 9E shows a cross sectional view along axial center of a bottom portion of a center post in an exemplary fire suppressor device in accordance with the present invention. The center post 9-33 has an integral ledge 9-80-33. Upon activation, bottom extension 9-26-*b* of the center guide 9-26, shown in FIG. 9D, meets with surface 9-80-*b* of the integral ledge 9-80-33 of the center post 9-33. Center post has an outer radius 9-33-*ro* slightly smaller than the inner radius 9-26-*ri* of the center guide 9-26, shown in FIG. 9D. In accordance with alternate embodiments, a center post may be affixed to a top wall of a plastic can. In accordance with an alternate embodiment, a center post may comprise a bottom bulb support. In alternate embodiments, a hollow cylindrical center post is affixed to the top of a plastic can and a lower pin and bulb support as a separate piece is used to form, in part, the closed container, automatic, thermal glass bulb activated fire suppressor. In still alternate embodiments, a cotter pin, hollow cylindrical center post, and lower pin and bulb support are used with an aluminum can.

Figure 10:
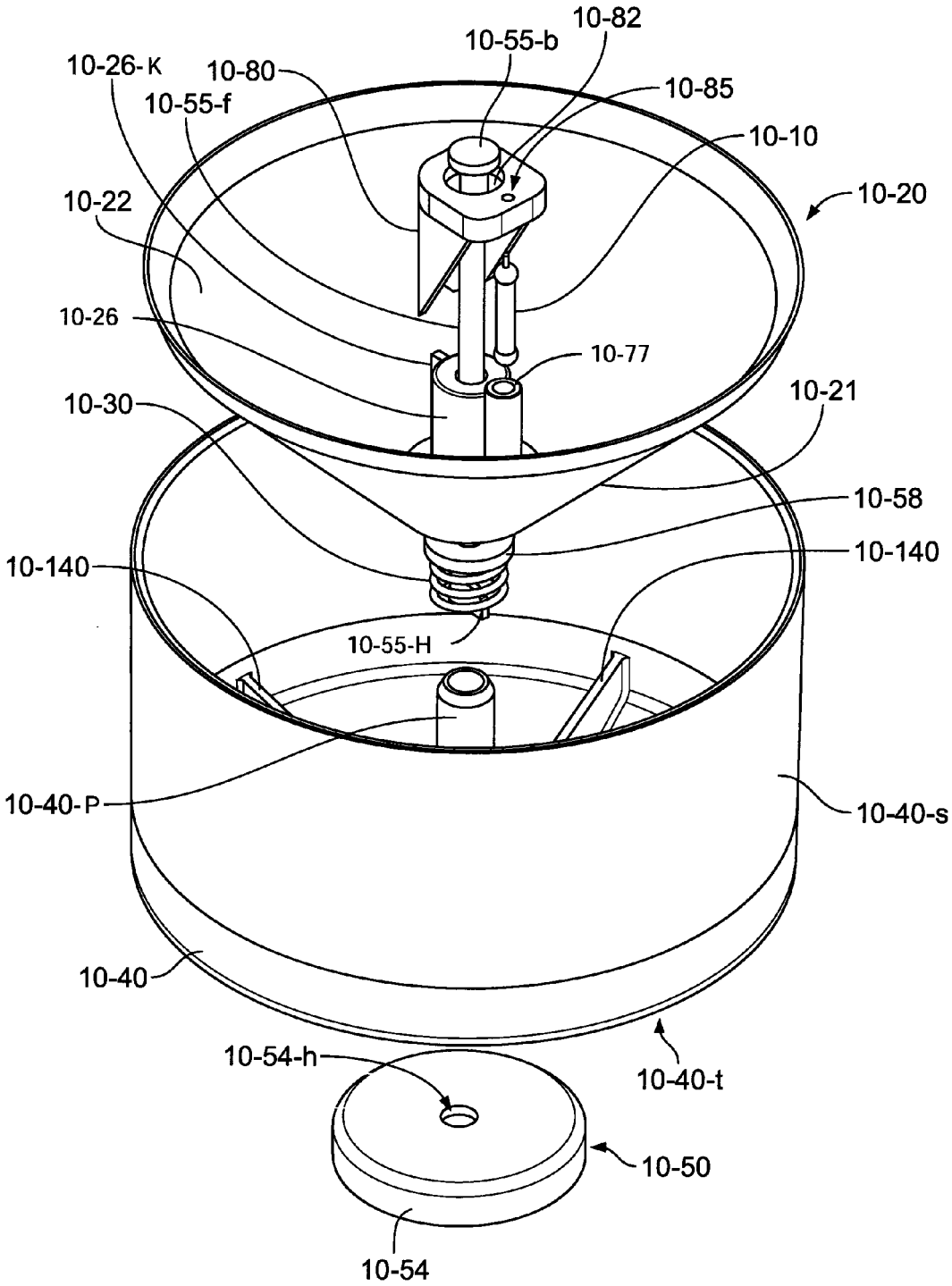
FIG. 10 shows an exploded view of a headed pin fire suppressor device in three dimensions from a bottom perspective, in accordance with an exemplary embodiment of the present invention.

FIG. 10 shows an exploded view of an inverted headed pin fire suppressor device in three dimensions from a bottom perspective, in accordance with an exemplary embodiment of the present invention. An outer side 10-22 of the cone lid 10-20 faces the positive Z direction in the present view, while an inner side 10-21 faces into the can 10-40. The container has a top wall 10-40-*t* and integral sidewalls 10-40-*s*. Ribs 10-140, also shown inside the can 10-40, provide structural support. In accordance with an exemplary embodiment, ribs may be integral to the top wall 10-40-*t* of the can 10-40 and/or to the side wall 10-40-*s*. In accordance with an exemplary embodiment, there are three ribs spaced 120 degrees apart. In accordance with the exemplary embodiment of FIG. 10, an off the shelf nail serves as the center headed pin with a head 10-55-*b* and a shaft 10-55-*f* and is formed as further describe below. The head of the shaft 10-55-*b* fits inside a bottom hole 10-82 of a bottom bulb and shaft support 10-80. Bulb 10-10 fits into a second through hole 10-85 in the bottom bulb and shaft support 10-80. In accordance with the exemplary embodiment shown in FIG. 10, a center guide 10-26 has an upper bulb support 10-77 and a key 10-26-*k*.

The center shaft 10-55-*f* of the headed pin passes into the center guide 10-26 and extends out the top of the cone lid into spring 10-30. A felt washer 10-58 is disposed between the inner side 10-21 of the lid and the spring 10-30. The bottom bulb and shaft support 10-80 has a 10-85 hole for thermal glass bulb 10-10. Beneath the can 10-40 is mounting assembly 10-50 and its magnet housing 10-54. When assembled, the tail 10-55-H of the headed pin sits within the magnet which is within the magnet housing. During assembly an original round tail passed through hole 10-54-*h* of the magnet housing 10-54, further described below. When the fire suppressor is assembled, the spring 10-30 will circumscribe center post 10-40-P. In accordance with an exemplary embodiment, the center post is integral to the can 10-40. A felt washer 10-58 is sandwiched between spring 10-30 and an inner side 10-21 of lid 10-20.

Figure 11:
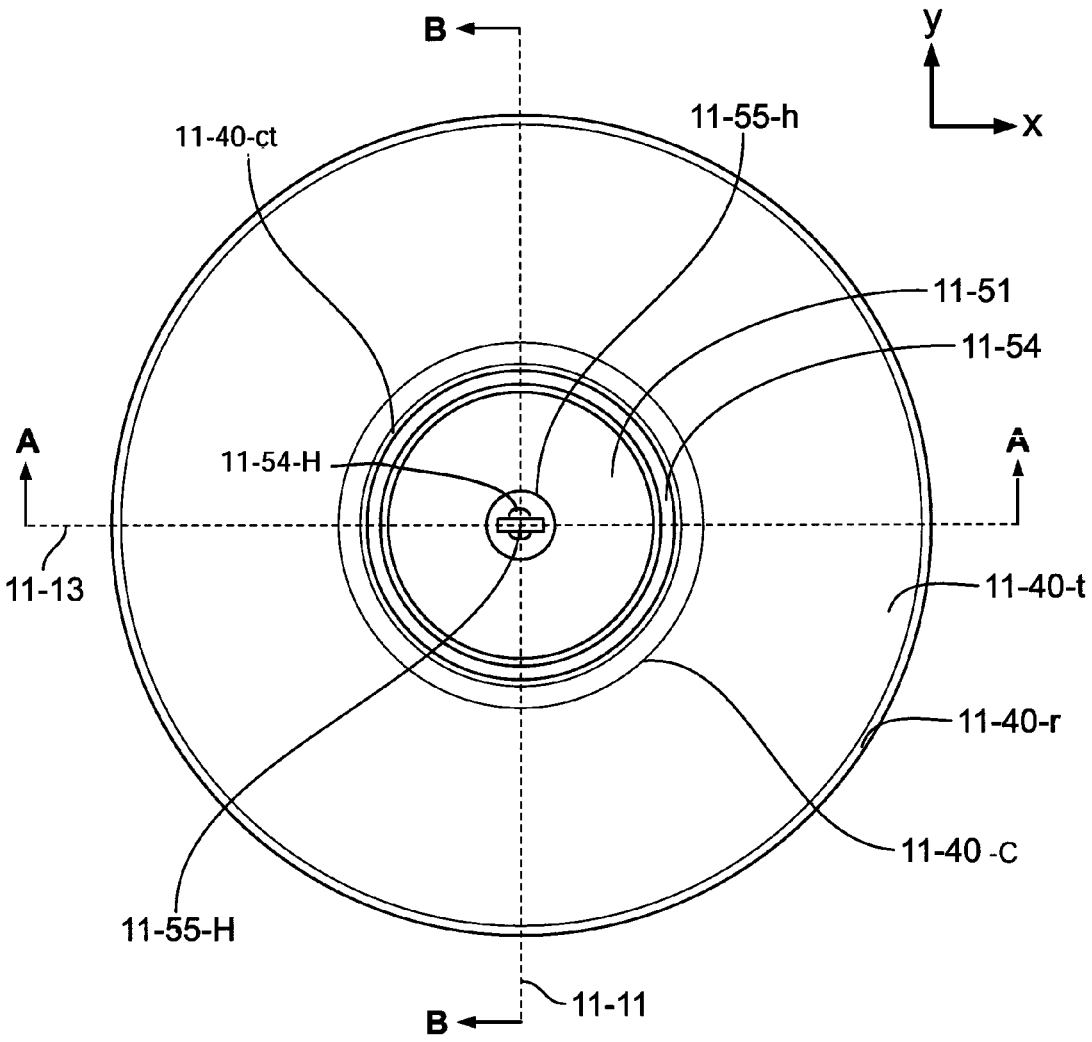
FIG. 11 shows a top view of a stovetop fire suppressor with a headed pin center shaft, in accordance with an exemplary embodiment of the present invention.

FIG. 11 shows a top view of a stovetop fire suppressor with a headed pin center shaft, in accordance with an exemplary embodiment of the present invention with cross section view lines B-B 11-11 and A-A 11-13 at right angles in the XY plane. In the top view, an outer edge of the top wall is shown 11-40-*r*, which may be rounded. Moving in towards the center, another edge is formed as a cup 11-40-C is indented in the top of the lid 11-40-*t*. The cup 11-40-C also has a channel 11-40-*ct* along its outer circumference. The cup 11-40-C, the channel 11-40-*ct*, and the magnet housing 11-54 are more particularly described with reference to FIG. 12B below. On the inside of the channel 11-40-*ct* the outer circumference of the magnet housing 11-54 is shown. Sitting just inside, and mounted therein, of the magnet housing 11-54 is a donut shaped magnet 11-51. In the hollow center of the magnet 11-54-*h* is the tail 11-55-H of the center shaft 10-55-*f*, the shaft shown, for example, in FIG. 10. The headed pin and its configuration composite of: head 10-55-*b* and shaft 10-55-*f*, shown in FIG. 10; tail 11-55-H, shown in FIG. 11, and shoulder 12-55-*sh*, shown in FIG. 12A, are further described below.

Figure 12A:
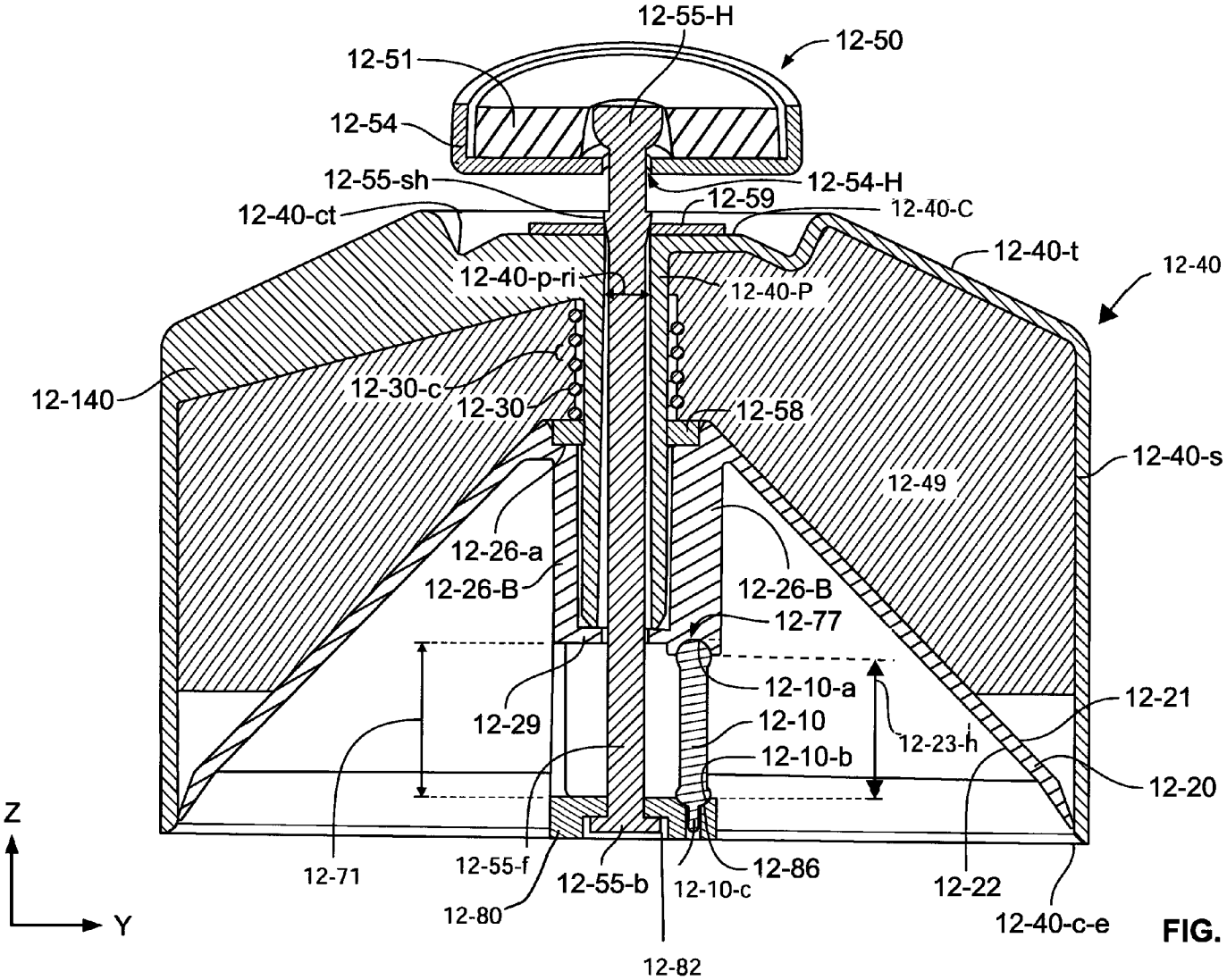
FIG. 12A shows a cross sectional view taken along line A-A of FIG. 11 of a stovetop fire suppressor in a closed state, in accordance with an exemplary embodiment of the present invention.

FIG. 12A shows a cross sectional view taken along line A-A 11-13 of FIG. 11 of a headed pin stovetop fire suppressor in a closed state, in accordance with an exemplary embodiment of the present invention. The device can 12-40 is shown with a cylindrical sidewall 12-40-*s* and a top wall 12-40-*t*. Turning to the top of the fire suppressor assembly, the uppermost Z direction, a mounting assembly 12-50 has a magnet housing 12-54 with a hole 12-54-H in its bottom surface. The magnet 12-51 has a hollow inner circular center with an inner diameter wider than the diameter of housing 12-54 hole 12-54-H, as shown in FIG. 12A. From the cross sectional view in FIG. 12A, an exemplary depth and cross section of circular cup depression 12-40-C, 11-40-C shown in FIG. 11, of the top wall 12-40-*t* can be seen. Also in accordance with the exemplary embodiment of FIG. 12A, the cross section configuration of channel 12-40-*ct* can be seen.

The shaft 12-55-*f* fits into the opening 12-54-H of the magnet housing 12-54. During assembly of the subject fire suppressor, in accordance with an exemplary embodiment, the end of the shaft 12-55-*f* is flattened into a tail 12-55-H, which fits within the hollow center of the magnet 12-51 and secures the fire suppressor device to the mounting assembly 12-50. Beneath the mounting magnet housing 12-54 is washer 12-59 which is disposed upon the bottom of the cup 12-40-C in the can top wall 12-40-*t*. At the outer side of washer 12-59 is channel 12-40-*ct* at the outer edge of the cup 12-40-C in the top wall 12-40-*t*; the channel 12-40-*ct* is described in further detail with reference to FIG. 12B.

The exemplary embodiment, shown in FIG. 12A, has a cone shaped bottom lid 12-20 with an inner side 12-21 and an outer side 12-22 and a center guide 12-26-B integral to the bottom lid. A top bulb support 12-77 is disposed in a bottom of a center guide 12-26-B on the right, Y direction, side. A top 12-10-*a* of a thermal glass bulb 12-10 fits into the support 12-77 with its bottom end 12-10-*b* seated in a bottom bulb support 12-86. The right, Y direction, side of the center guide 12-26-B extends lower than a shoulder 12-29 of the center guide 12-26-B. In accordance with an exemplary embodiment, the upper 12-77 and lower bulb 12-86 bulb support span the height 12-23-*h* of the opening upon fire suppressor activation. The distance 12-71 from shoulder 12-29 of the center guide 12-26-B to the bulb and shaft support 12-80 is greater than the drop height 12-23-*h*, in accordance with the exemplary embodiment of FIG. 12A. The cone shaped bottom lid 12-20 closes the fire suppressing device forming a closed container in the inactive state. Fire suppressing agent is stored in the hollow center 12-49 of the can with lid device.

Center guide 12-26-B has an open inner diameter, the diameter centered with respect to the lid 12-20 in the XY plane. Within the center guide 12-26-B is the center post 12-40-P also with an inner diameter 12-40-*p-ri*. These diameters are shown in more detail in FIG. 14B. A lower portion of center post 12-40-P fits inside center guide 12-26-B and may rest upon shoulder 12-29 when the fire suppressor is in its closed inactive state, in accordance with an exemplary embodiment. At a top of the cone lid 12-20 and atop center guide 12-26-B is a washer seat 12-26-*a*. In accordance with the exemplary embodiment of FIG. 12A, a felt washer 12-58 is sandwiched between seat 12-26-*a* and compression spring 12-30. In alternate embodiments an alternate washer type may be disposed between the guide 12-26-B and the spring 12-30. In still alternate embodiments, a washer may sit atop the guide 12-26-B in the absence of an indentation for a washer seat or a washer may be omitted with the spring butting up against the center guide 12-26-B.

A support rib 12-140 is seen in the cross sectional view of FIG. 12A, taken along line A-A of FIG. 11. In accordance with an exemplary embodiment the ribs are integral to the can 12-40 top wall 12-40-*t* and side wall 12-40-*s*. In accordance with an exemplary embodiment, there may be three ribs spaced 120 degrees apart and extending from the center post 12-40-P to the side wall 12-40-*s*. The ribs 12-140 may be integral to the top wall and may be integral to the side wall 12-40-*s*, secured to the side wall 12-40-*s*, or may extend close to the side wall 12-40-*s*. In accordance with an alternate embodiments, support ribs span a large portion of the can radius along an inner top wall and are inserted and secured to the top wall 12-40-*t* and/or the side wall 12-40-*s* with, for example, an adhesive. Indentations for seating of ribs may be disposed in the top wall 12-40-*t* or in the cylindrical side wall 12-40-*s*, indentations not shown.

Turning to the bottom, negative Z direction, a head 12-55-*b* of head pin shaft 12-55-*f* fits inside a bottom hole 12-82 of the bottom bulb and shaft support 12-80. Extending upwards, Z, from bulb and shaft support 12-80 is a headed pin shaft 12-55-*f* and a thermal glass bulb 12-10. Headed pin shaft 12-55-*f* functions as the device center shaft and extends through the center of the can 12-40 and up into the mounting assembly 12-50. The shaft 12-55-*f* fits through the opening in shoulders 12-29 of the center guide and extends up through the inner core of the center post 12-40-P. The outer diameter of the shaft 12-55-*f* fits within the diameter 12-40-P-ri of the inner core of the center post 12-40-P and exits out a top opening of the center post 12-40-P. A washer 12-59, metal in accordance with an exemplary embodiment, is juxtaposition the top wall and the shaft 12-55-*f* passes there through. During manufacturing, the shaft is flattened forming a shoulder 12-55-*sh* as shown, securing the fire suppressor in its closed inactivated state. Washer 12-59 distributes compressing load from the shaft shoulder 12-55-*sh* across a larger surface area on the top wall 12-40-*t*. An upper portion of the remaining unflattened shaft extends up into opening 12-54-H of the magnet housing as described above.

A compression spring 12-30 surrounds the center post 12-40-P. FIG. 12A shows a stovetop fire suppressor in the closed position, in turn, spring 12-30 is in a compressed 12-30-*c* state. Spring 12-30 extends from a top inner surface of the ribs 12-140 to the center guide 12-26-B. Shoulder 12-29 and top bulb support 12-77 are separated from a bottom bulb and shaft support 12-80 to afford a fire suppressor opening height 12-23-*h* upon activation.

Figure 12B:
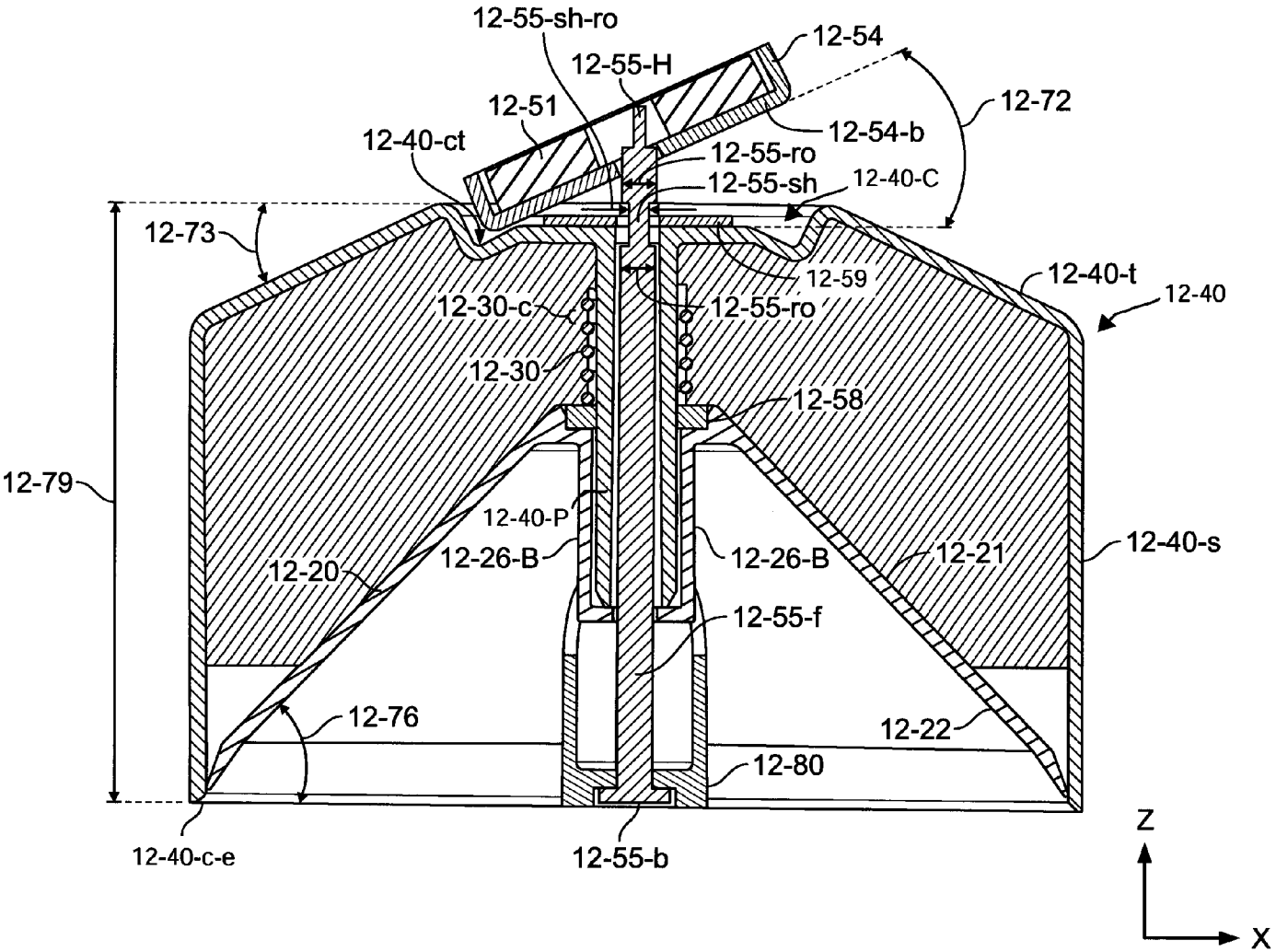
FIG. 12B shows a cross sectional view taken along line B-B of FIG. 11 of a stovetop fire suppressor in a closed inactivated state, in accordance with an exemplary embodiment of the present invention.

FIG. 12B shows a cross sectional view taken along line B-B 11-11 of FIG. 11 of a stovetop fire suppressor in a closed inactivated state, in accordance with an exemplary embodiment of the present invention. The outer diameter of the shaft 12-55-*ro* is less than the diameter of magnet housing opening 12-54-H, shown in 12A. The clearance of the shaft 12-55-*f* through the hole 12-54-H in the magnet housing 12-54 affords tilting of the mounting housing 12-54, as shown in FIG. 12B. The magnet housing 12-54 can tilt till its underside 12-54-*b* touches the cup 12-40-C or the channel 12-40-*ct* of the cup. In accordance with an exemplary embodiment, the underside of the magnet housing 12-54-*b* and the bottom cup surface can form an angle 12-72 of 25 degrees when housing 12-54 is seated into one edge of the channel 12-40-*ct*. In accordance with an exemplary embodiment, the top wall 12-40-*t* may have an angle 12-73 of decline with respect to the fire suppressor axis relative to the XY plane. In accordance with the exemplary embodiment of FIG. 12B, the top wall 12-40-*t* of the can 12-40 is slanted downward, negative Z direction, at an angle 12-73 of 20 degrees. Other top wall configurations may be desired, for example, in alternate embodiments, the top wall 12-40-*t* may be a horizontal plane. In accordance with an exemplary embodiment a height 12-79 of a closed fire suppressor may be near 3.25 inches. In accordance with the exemplary embodiment of FIGS. 12A-13B, the cup 12-40-C has slanted side walls.

A fire suppressing agent, not shown, is stored in the can 12-40 interior space 12-49. Cone lid 12-20 forms an angle 12-76 relative to the horizontal plane X-Y, which, in part, directs flow of the fire suppressing agent upon activation of the fire suppressing device. Both the inner side 12-21 and outer side 12-22 of the cone lid 12-20 are shown. The inner side 12-21 of the cone lid 12-20 may be smooth, textured, or may also comprise ribs. The outer edge of the cross sectional view taken across line B-B in FIG. 11 and shown in FIG. 12B shows device symmetry about a vertical Z axis centered in the fire suppressor. Many elements, such as center post 12-40-P, are symmetrical across lines A-A and B-B of FIG. 11, as shown across in FIGS. 12A and 12B. Referring again to FIG. 12B, the cross section shows the symmetry of the center guide 12-26-B in the ZX plane. Similarly, the bottom bulb and shaft support 12-80 is symmetrical about the device shaft 12-55-*f* in the ZX plane.

Extending upwards, Z, from the bulb and shaft support 12-80 is a headed pin shaft 12-55-*f*. In the ZX plane at axis center, line B-B in FIG. 11, a thermal bulb is not seen. The bottom bulb and shaft support 12-80 in this view and is symmetrical about the headed pin shaft 12-55-*f* in the Z direction. Head 12-55-*b* of headed pin shaft 12-55-*f* is shown seated inside a bottom hole 12-82 of a bottom bulb and shaft support 12-80. Headed pin shaft 12-55-*f* functions as the device center shaft and extends through the center of the can 12-40 and up into the mounting assembly 12-50. The shaft 12-55-*f* fits through the opening in shoulders 12-29 of the center guide 12-26-B and extends up through the inner core of the center post 12-40-P. The outer diameter 12-55-*ro* of the shaft 12-55-*f* fits within the inner core, diameter 12-40-P-ri shown in FIG. 12A, of the center post 12-40-P and exits out a top opening of the center post 12-40-P.

A washer 12-59, metal in accordance with an exemplary embodiment, is juxtaposition the top wall and the shaft 12-55-*f* passes there through. During manufacturing, the shaft is flattened across the ZY plane forming a shoulder 12-55-*sh*, shown in FIG. 12A, securing the fire suppressor in its closed inactivated state. The flattened shoulder 12-55-*sh* of shaft 12-55-*f* of FIG. 12A is shown as a narrow portion 12-55-*sh* in FIG. 12B. In accordance with an exemplary embodiment, the original shaft diameter 12-55-*ro* to narrowed diameter 12-55-*sh*-*ro* need not be a step transition. And similarly the increase from the flattened cross section 12-55-*sh*-*ro* need not be a step back up to the original shaft diameter 12-55-*ro*. An upper portion of the remaining unflattened shaft, diameter 12-55-*ro*, extends up into the magnet housing 12-54, which is subsequently flattened in manufacture, as described above. Washer 12-59 distributes the load from the shoulder 12-55-*sh* across a larger surface area as compared to the shoulder 12-55-*sh* and cup 12-40-C interface. The flattened portion 12-55-*sh* also presses on the inner opening of metal washer l2-59, avoiding pressure on the core of the center post 12-40-P. The relative diameters of washer 12-59 and the inner diameter of the center post are discussed in more detail with reference to FIG. 13C.

A compression spring 12-30 surrounds the center post 12-40-P. FIGS. 12A and 12B shows a stovetop fire suppressor in the closed position, in turn, spring 12-30 is in a compressed 12-30-*c* state. Referring again to FIG. 12B, spring 12-30 extends from a top inner surface of the ribs 12-140, not shown, and the felt washer 12-58 seated atop the center guide l2-26-B. The can sidewall 12-40-*s* is chamfered 12-40-*c*-*e* at its bottom edge. An exemplary configuration of the bottom of the can sidewall and the cone lid interface are described in more detail with reference to FIG. 4E above.

Figure 13A:
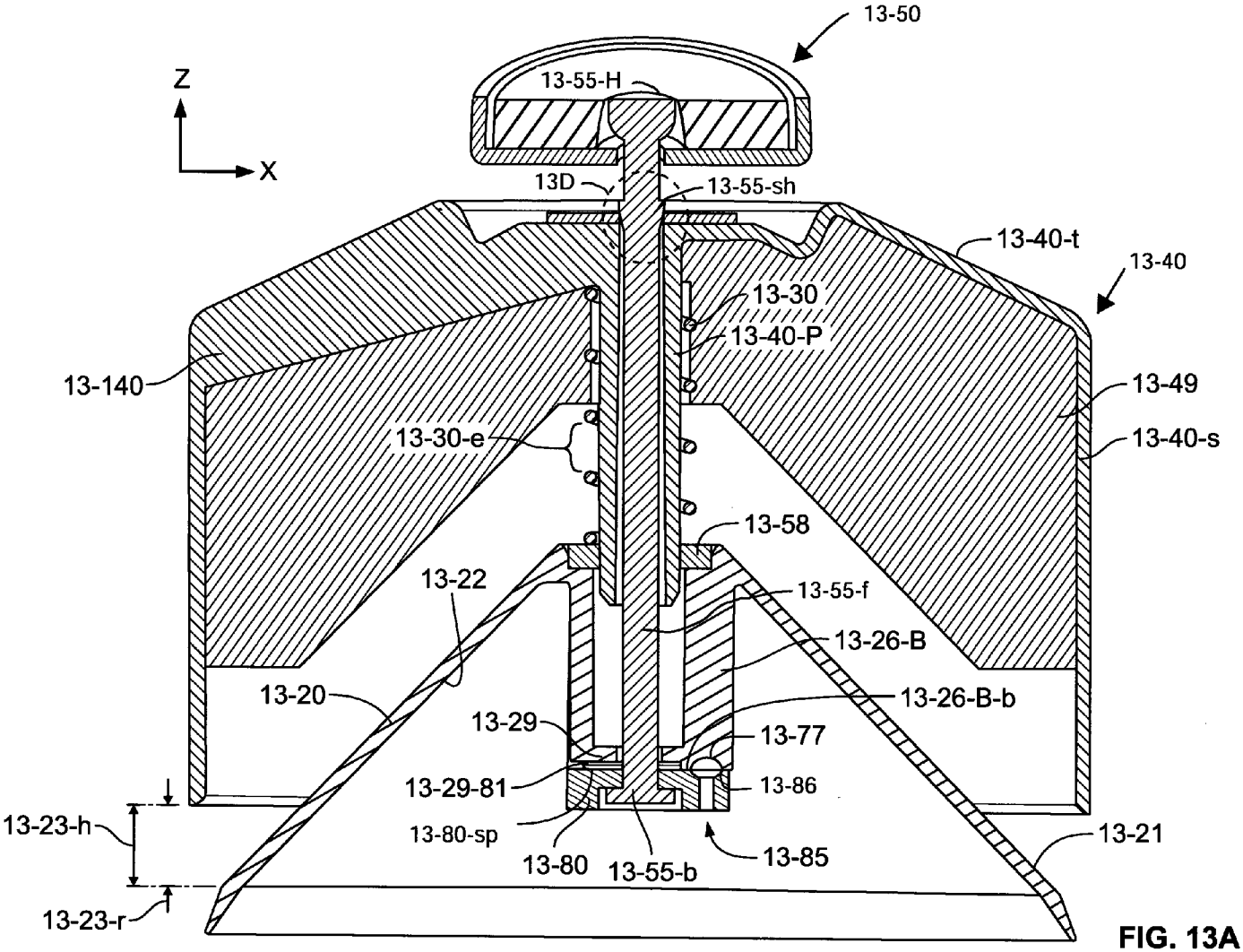
FIG. 13A shows a cross sectional view taken along line A-A of FIG. 11 of a stovetop fire suppressor in an open activated state, in accordance with an exemplary embodiment of the present invention.

FIG. 13A shows a cross sectional view taken along line A-A of FIG. 11 of a stovetop fire suppressor in an open activated state, in accordance with an exemplary embodiment of the present invention. In its closed state FIGS. 12A and 12B, a fire suppressing agent, not shown, is housed in the closed container 12-40. Referring again to FIG. 13A, lid 13-20 has separated from and dropped below a side wall 13-40-*s* by a drop height of 13-23-*h*. Fire suppressing agent, not shown, is distributed out the radial opening 13-23-*r* when the cone lid 13-20 drops. The bottom of the side wall 13-40-*s* and the outer circumference of the lid 13-20 are shown and described more particularly above with reference to FIG. 4E, in accordance with an exemplary embodiment.

Spring 13-30 is shown in its extended, less compressed, state 13-30-*e*. The spring 13-30 extends from a top inner surface of ribs 13-140 to the felt washer 13-58 mounted on the center guide 13-26-B. In accordance with an exemplary embodiment, ribs 13-140 are integral to, or otherwise affixed to, the top wall 13-40-*t*.

Center guide 13-26-B is integral to the cone shaped bottom lid 13-20. In the open activated state of FIG. 13A, the thermal glass bulb, 12-10 shown in FIG. 12A, has broken with heat activation and the compressed spring, 12-30-*c* shown in FIG. 12A, extends 13-30-*e* to lower the cone shaped lid 13-20 into the position of FIG. 13A. In accordance with an exemplary embodiment, the spring 13-30 may be a helical compression spring. It may have a free length of 1.5 inches and a load rate of 6.0 lbs/inch. The spring may be zinc plated steel and have a wire diameter of 0.05 inches.

As the lid 13-20 lowers, shoulder 13-29 drops towards surface 13-29-81. The right side 13-26-B-*b* of center guide 13-26-B extends lower, negative Z direction, beneath shoulder 13-29 and forms the upper bulb rest 13-77. In the exemplary embodiment of FIG. 13A, a bottom of top bulb support 13-77 rests a top lower bulb support 13-86 in the activated state. In the present embodiment, the lower bulb support 13-86 contributes to a catching surface for the lid 13-20 as the spring 13-30 pushes the lid 13-20 downwards. The upper 13-77 bulb support, the lower 13-86 bulb support, and the bulb through hole 13-85 are shown empty. Upper and lower bulb supports, and an exemplary catching surface for the center guide upon the lower shaft and bulb support when the fire suppressor activates is described below with reference to FIGS. 14A-D. Referring again to FIG. 13A, the shoulder 13-29 of the center guide 13-26-B is shown slightly above the upper surface 13-29-81 forming space 13-80-*sp*.

Head 13-55-*b* of headed pin shaft 13-55-*f* is shown seated in the bottom bulb and shaft support 13-80. With activation, the center guide 13-26-B and the lid 13-20 lower but shaft 13-55-*f*, head 13-55-*b*, and bottom bulb and shaft support 13-80 remain in the same vertical, Z direction, position. The mounting assembly 13-50 remains secured above the stovetop surface. The shaft tail 13-55-H remains affixed to the mounting assembly 13-50, keeping the activated fire suppressing unit suspended above the stovetop. The shoulder 13-55-*sh* area 13D is shown in greater detail in FIG. 13D. The spring 13-30 is retained between the ribs 13-140 and the top of the center guide 13-26-B and encircled about the center post 13-40-P. A bottom portion of the center post 13-40-P remains disposed in an upper portion of the hollow center guide 13-26-B.

Figure 13B:
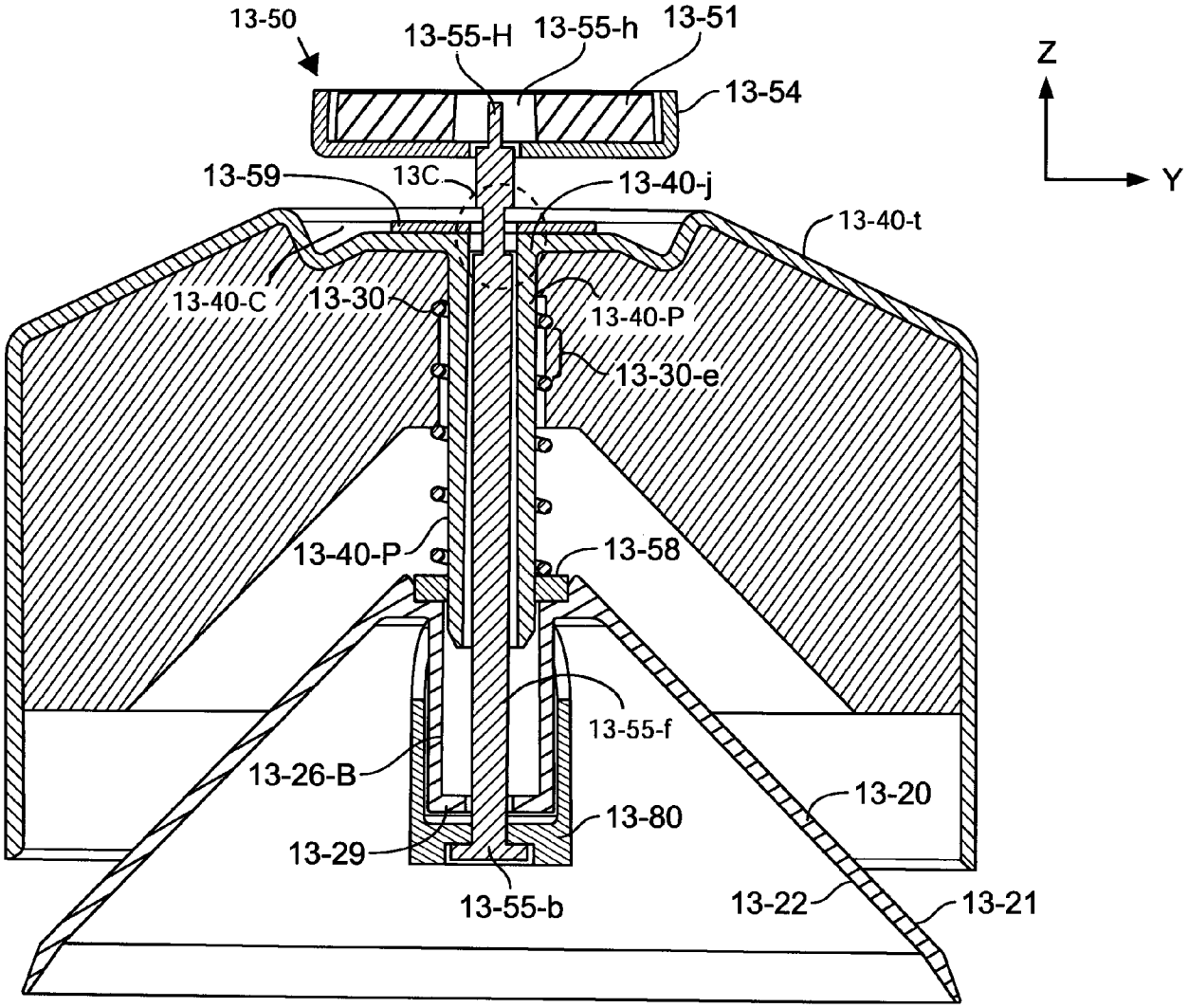
FIG. 13B shows a cross sectional view taken along line B-B of FIG. 11 of a stovetop fire suppressor in an open activated state, in accordance with an exemplary embodiment of the present invention.

FIG. 13B shows a cross sectional view taken along line B-B of FIG. 11 of a stovetop fire suppressor in an open activated state, in accordance with an exemplary embodiment of the present invention. The view along line B-B shows the profile of the top wall 13-40-*t* in the absence of ribs, which according to the exemplary embodiment of FIGS. 12A-B and 13A-B are spaced 120 degrees apart. The cup 13-40-C is integral to the center post 13-40-P and the junction of the two 13-40-*j* is identified in this view. As the lid 13-20 drops, the fire suppressor remains held together via the shaft 13-55-*f* between its tail 13-55-H and 13-55-*b* head. Further, the stovetop fire suppressor is secured via the shaft tail 13-55-H to mounting assembly 13-50. In practice the magnet 13-51 within housing 13-54 is affixed above the stovetop and the shaft tail 13-55-H is secured within hollow magnet center 13-55-*h*.

The spring 13-30 is retained between the ribs 13-140, not shown, and the top of the center guide 13-26-B and encircled about the center post 13-40-P. When the thermal glass bulb, not shown, breaks, the compressed spring energy expands the spring towards its resting length. The lid breaks free and lowers, while the shaft shoulder 13-55-*sh* is held firm within the inside of washer 13-59. The shoulder 13-55-*sh* area is shown and described in more detail in FIG. 13C.

A bottom portion of the center post 13-40-P remains disposed in an upper portion of the hollow center guide 13-26-B. In this view the bulb support portion, upper or lower, of the shaft and bulb support 13-80 and of the center guide 13-26-B, respectively, are not shown. As in the view of FIG. 13A, shoulder 13-29 of the center guide 13-26-B is shown displaced just above the bottom shaft and bulb support 13-80.

Figure 13C:
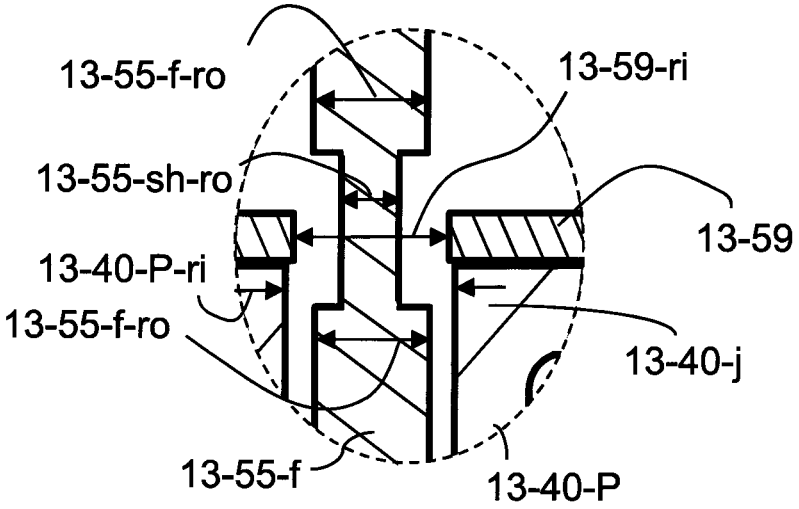
FIG. 13C shows a shaft shoulder portion of FIG. 13B in greater detail, in accordance with an exemplary embodiment.

FIG. 13C shows a shoulder portion of FIG. 13B in greater detail. In accordance with an exemplary embodiment, the diameter of the inner washer 13-59-*ri* opening is slightly smaller than the inner core diameter 13-40-P-ri of the center post 13-40-P and slightly larger than the original shaft diameter 13-55-*f-ro*. In the cross sectional view of FIGS. 13B and 13C, the shoulder diameter is narrowed 13-55-*sh-ro*. In contrast, in the cross sectional view of FIG. 13A, line A-A in FIG. 11, the shoulder 13-55-*sh* is flattened to snugly fit in the diameter 13-59-*ri*. This shoulder area is shown in greater detail in FIG. 13D. This deformation of the shaft at the washer, holds the can in position upon activation of the fire suppressor, expansion of the spring, and lowering of the cone lid. Referring again to FIG. 13C, The shaft 13-55-*f* is flattened from an original diameter 13-55-*f-ro* to a narrow diameter 13-55-*sh-ro*, in the present view, and then widens again 13-55-*f-ro* to its original diameter. In accordance with an exemplary embodiment, the diameter of the inner washer 13-59 opening is slightly smaller than the inner core diameter 13-40-P-ri of the center post 13-40-P and slightly larger than the original shaft diameter 13-55-*f-ro*

Figure 13D:
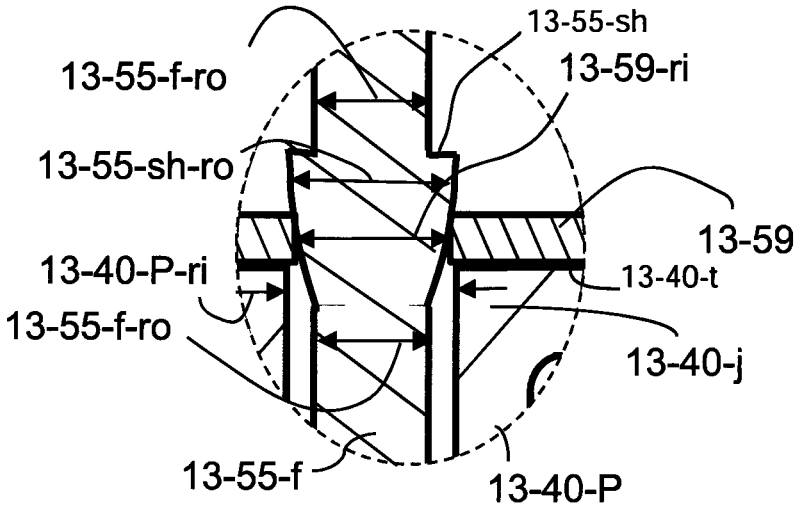
FIG. 13D shows a shaft shoulder portion of FIG. 13A in greater detail, in accordance with an exemplary embodiment.

FIG. 13D shows a shoulder portion of FIG. 13A in greater detail. In accordance with an exemplary embodiment, the diameter of the inner washer 13-59-*ri* opening is slightly larger than the original shaft diameter 13-55-*f-ro*. In the cross sectional view of FIGS. 13A and 13D, the shoulder diameter 13-55-*sh-ro* is widened. The shoulder 13-55-*sh* is flattened to snugly fit in the diameter 13-59-*ri* of washer 13-59. This deformation of the shaft at the washer, holds the can in position upon activation of the fire suppressor, expansion of the spring, and lowering of the cone lid. Referring again to FIG. 13D, the shaft 13-55-*f* is flattened from an original diameter 13-55-*f-ro* to a wider diameter 13-55-*sh-ro*, in the present view, and then narrows again 13-55-*f-ro* to its original diameter. In accordance with an exemplary embodiment, the diameter of the inner washer 13-59 opening is slightly smaller than the inner core diameter 13-40-P-ri of the center post 13-40-P. During manufacturing, the shaft is flattened forming a shoulder 13-55-*sh* as shown, securing the fire suppressor in its closed inactivated state. Washer 13-59 distributes compressing load from the shaft shoulder 13-55-*sh* across a larger surface area on the top wall 13-40-*t*. Washer 13-59 absorbs radial pressure from the shaft shoulder 13-55-*s*, protecting the top of the center post 13-40-P and the junction 13-40-*j* region.

Figure 14A:
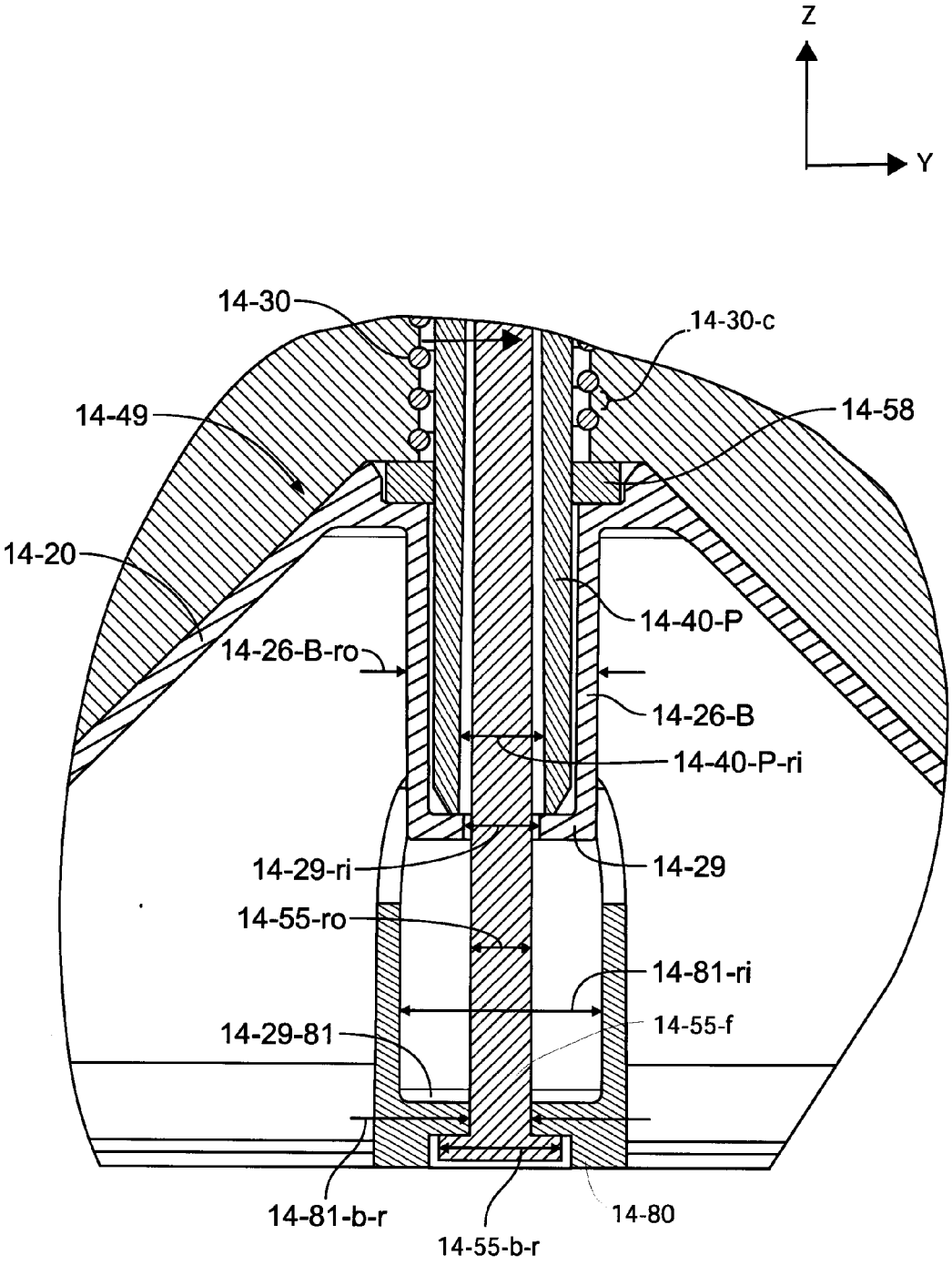
FIGS. 14A and 14B; cross sectional views of the shaft and bulb support area of a fire suppressor along line B-B in FIG. 11 in an inactivated and in an open state, respectively, in accordance with an exemplary embodiment of the present invention.
Figure 14B:
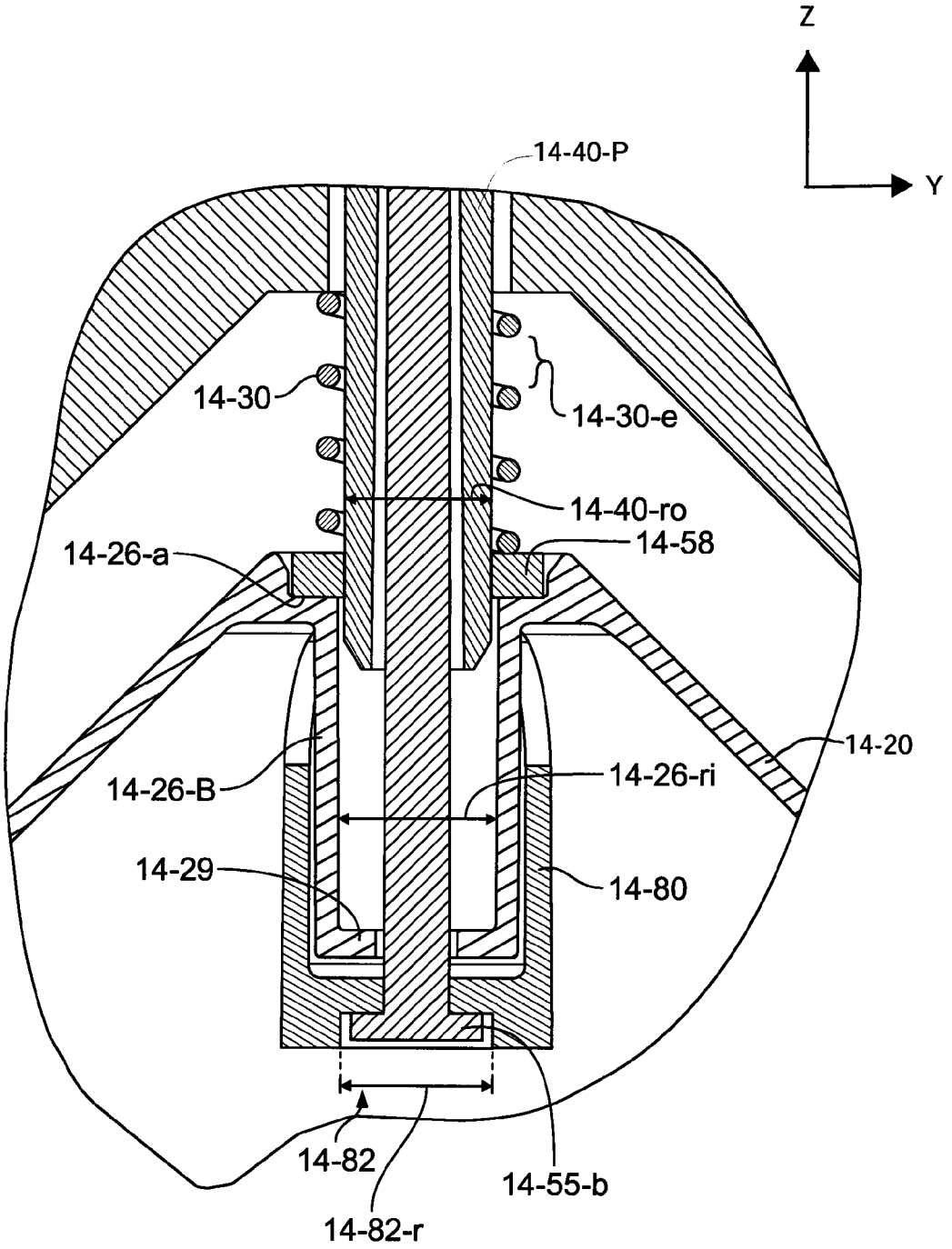

FIGS. 14A and14B show cross sectional views of the shaft and bulb support along line B-B in FIG. 11 in an inactivated and in an open state, respectively, in accordance with an exemplary embodiment of the present invention. Turning first to FIG. 14A, the diameter of the head 14-55-*b-r* is larger than the upper, Z direction, opening 14-81-*b-r* and the shaft 14-55-*f* passes there-through. The outer diameter 14-26-B-ro of the center guide 14-26-B fits inside the hollow center diameter 14-81-*ri* of the bottom shaft and bulb support 14-80. The center post 4-40-P is fully descended into the center guide in this inactivated state, in accordance with the exemplary embodiment of FIG. 14A. The spring 14-30 is shown in its compressed 14-30-*c* state with the can interior 14-49 shown above the cone shaped lid 14-20. A felt washer 14-58 is sandwiched between the spring 14-30 and a top of the center guide 14-26-B.

FIG. 14B shows a cross sectional view of the shaft and bulb support along line B-B in FIG. 11 in an open state, respectively, in accordance with an exemplary embodiment of the present invention. The spring 14-30 is shown in its extended state 14-30-*e*. The felt washer 14-58 has lowered with the extending spring and remains seated in a washer seat 14-26-*a* upon the top of the lid 14-20, at the center guide 14-26-B. The center guide, in accordance with the exemplary embodiment of FIG. 14B, is integral to the lid 14-20. The inner diameter 14-26-*ri* of center guide 14-26-B accommodates the outer diameter 14-40-*ro* of the center post 14-40-P. A lower portion, negative Z direction, of center post 14-40-P remains within the hollow center of an upper portion of the center guide 14-26-B. The head of the shaft 14-55-*b* fits inside a diameter 14-82-*r* of bottom hole 14-82 of a bottom bulb and shaft support 14-80.

Figure 14D:
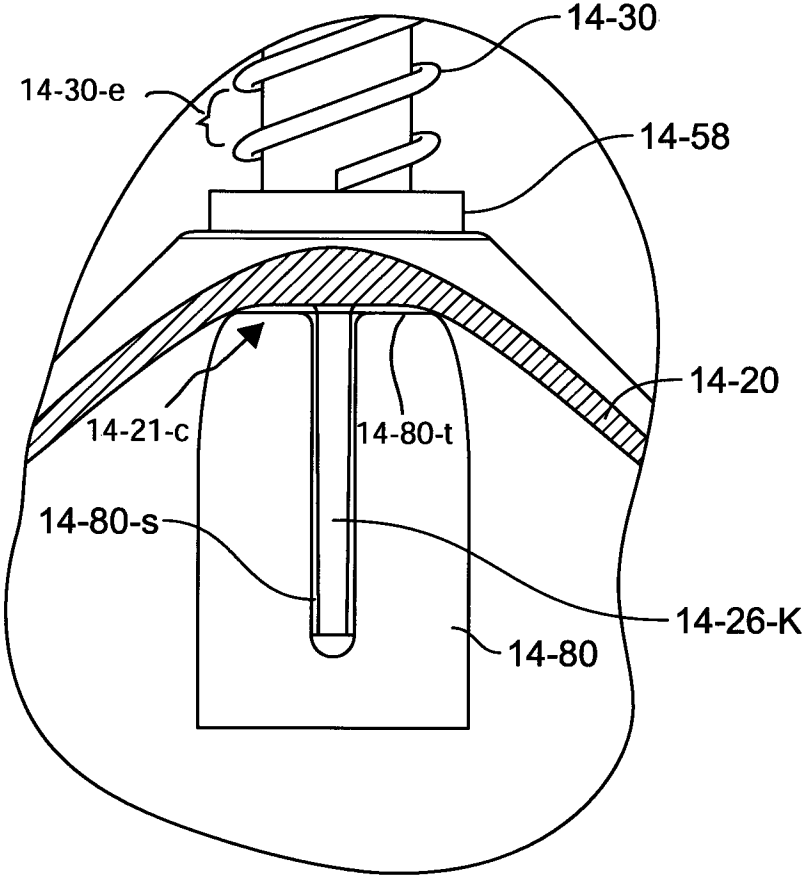
FIGS. 14C and 14D show back views of guide center key and the slot in the shaft bulb support area of a fire suppressor in a closed and an open state, respectively, in accordance with an exemplary embodiment of the present invention.
Figure 14C:
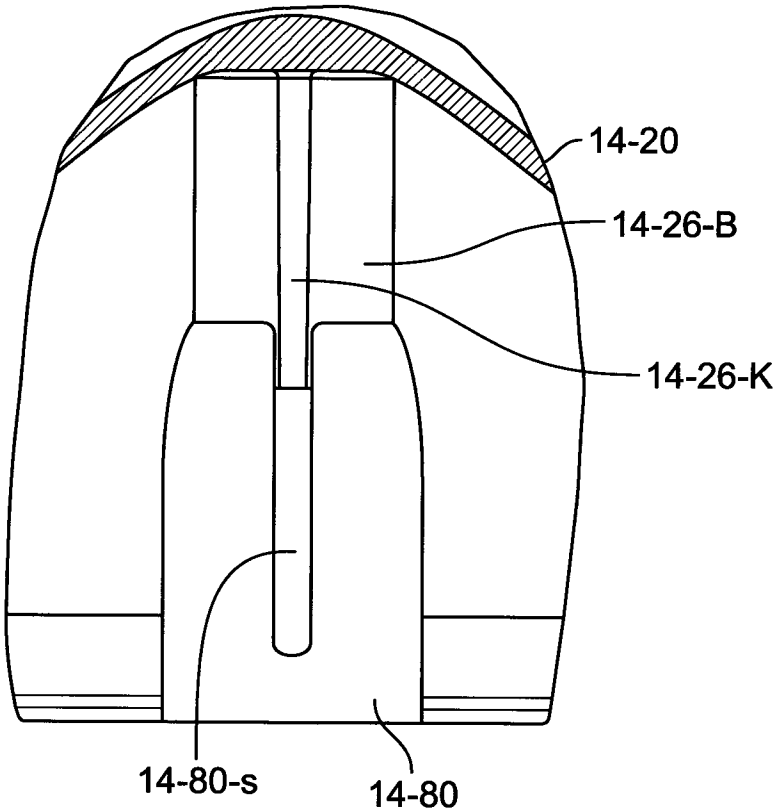

FIGS. 14C and 14D show back views of guide center key and the slot in the shaft bulb support area of a fire suppressor in a closed and an open state, respectively, in accordance with an exemplary embodiment of the present invention. In FIG. 14C, a lower portion of the key 14-26-K fits just inside a top portion of slot 14-80-*s* of the bottom bulb and shaft support 14-80. The center guide 14-26-B is shown with a cross section of the lid 14-20. Turning to FIG. 14D, the fire suppressor is in its activated state. In accordance with an exemplary embodiment, key 14-26-K has dropped down through slot 14-80-*s*. In accordance with an exemplary embodiment, the key 14-26-K catches on a bottom of the slot 14-80-*s*. In addition to this catching surface, or in alternative to this catching surface configuration, an inner center lid 14-21-*c* portion catches on the top of the bottom bulb and shaft support 14-80-*t*. In accordance with an exemplary embodiment, the outer sides of the key are sandwiched with a narrowing of a slot bottom, negative Z direction. In alternate embodiments, the key 14-26-K provides stabilization about the XY plane but does not contribute to a stop of the lid 14-20 in its downward trajectory upon activation of the fire suppressor.

Figure 15A:
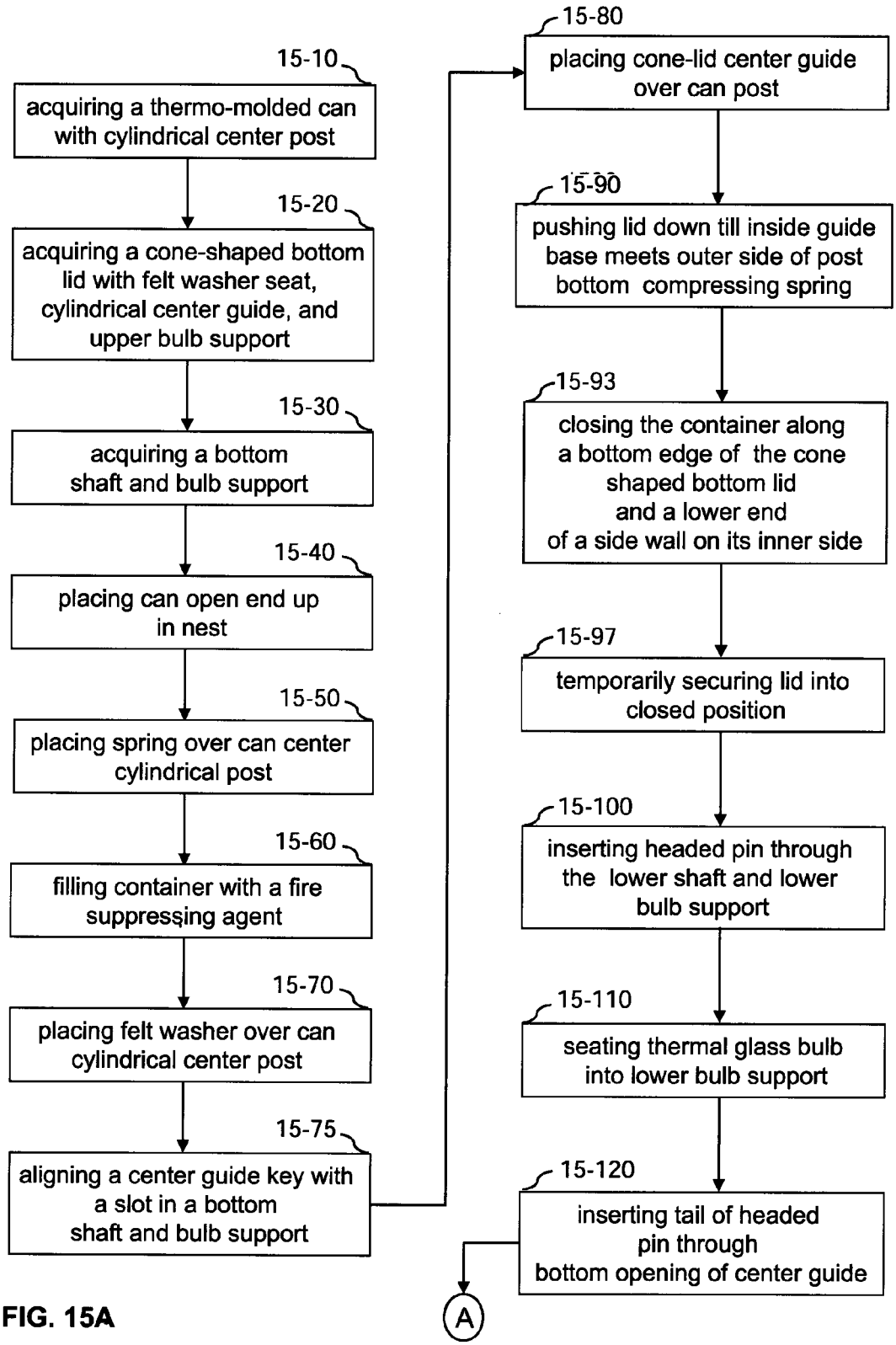
FIGS. 15A and 15B show an exemplary method of assembling a headed pin automatic stovetop fire suppressor with fire suppressing agent.
Figure 15B:
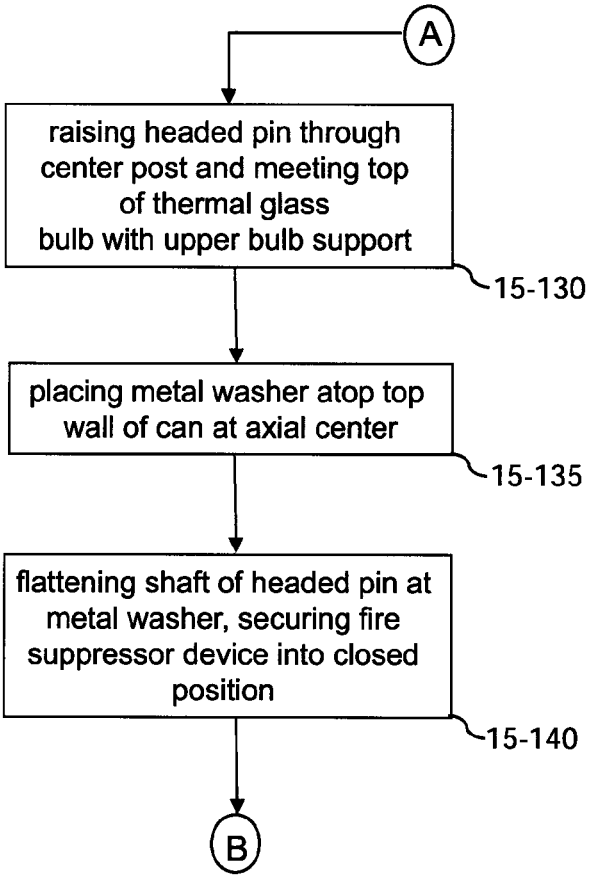

FIGS. 15A-15B show an exemplary method of assembling a headed pin automatic stovetop fire suppressor with fire suppressing agent, in accordance with an exemplary embodiment of the present invention. A method of assembling an automatic stovetop fire suppressor, in accordance with an exemplary embodiment includes: acquiring a thermo-molded can with cylindrical center post 15-10; acquiring a cone-shaped bottom lid with felt washer seat, cylindrical center guide, and upper bulb support 15-20; acquiring a bottom shaft and bulb support 15-30; placing the can open end up in nest 15-40; placing a spring over can center cylindrical post 15-50; filling container with a fire suppressing agent 15-60; placing a felt washer over can cylindrical center post 15-70; aligning a center guide key with a slot in a bottom shaft and bulb support 15-75; placing the cone-lid center guide over can post 15-80; pushing lid down till inside guide base meets outer side of post bottom compressing spring 15-90; closing the container along a bottom edge of the cone shaped bottom lid and a lower end of a side wall on its inner side 15-93; temporarily securing lid into closed position 15-97; inserting headed pin through the lower shaft and lower bulb support 15-100; seating thermal glass bulb into lower bulb support 15-110; inserting tail of headed pin through bottom opening of center guide 15-120; raising headed pin through center post and meeting top of thermal glass bulb with upper bulb support 15-130; placing metal washer atop top wall of can at axial center 15-135; flattening shaft of headed pin at metal washer, securing fire suppressor device into closed position 15-140.

Figure 15C:
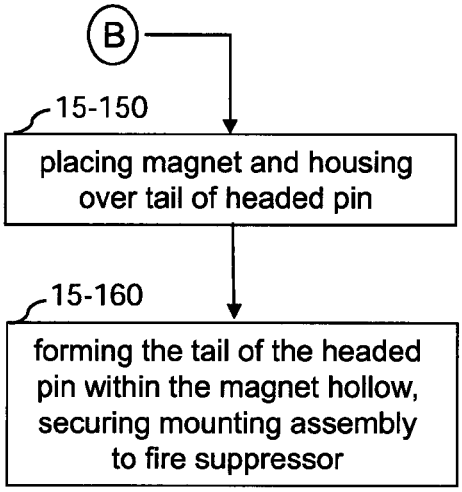
FIG. 15C shows the exemplary method of FIGS. 15A and 15B further including a mounting housing, in accordance with an exemplary embodiment of the present invention.

FIG. 15C shows another exemplary method in accordance with an embodiment of the present invention to include mounting of an assembled fire suppressor. In accordance with another exemplary method of assembly embodiment, shown in FIGS. 15A-15B, the method further includes: placing magnet and housing over tail of headed pin 15-150; and forming the tail of the headed pin within the magnet hollow, securing mounting assembly to fire suppressor 15-160. In accordance with alternate embodiments, different center shafts may require alternate methods of securing the fire suppressor in the closed inactivated state. Similarly, the attaching method for securing the fire suppressor to the mounting assembly may vary across fire suppressors and across different center shaft embodiments.

Figure 16A:
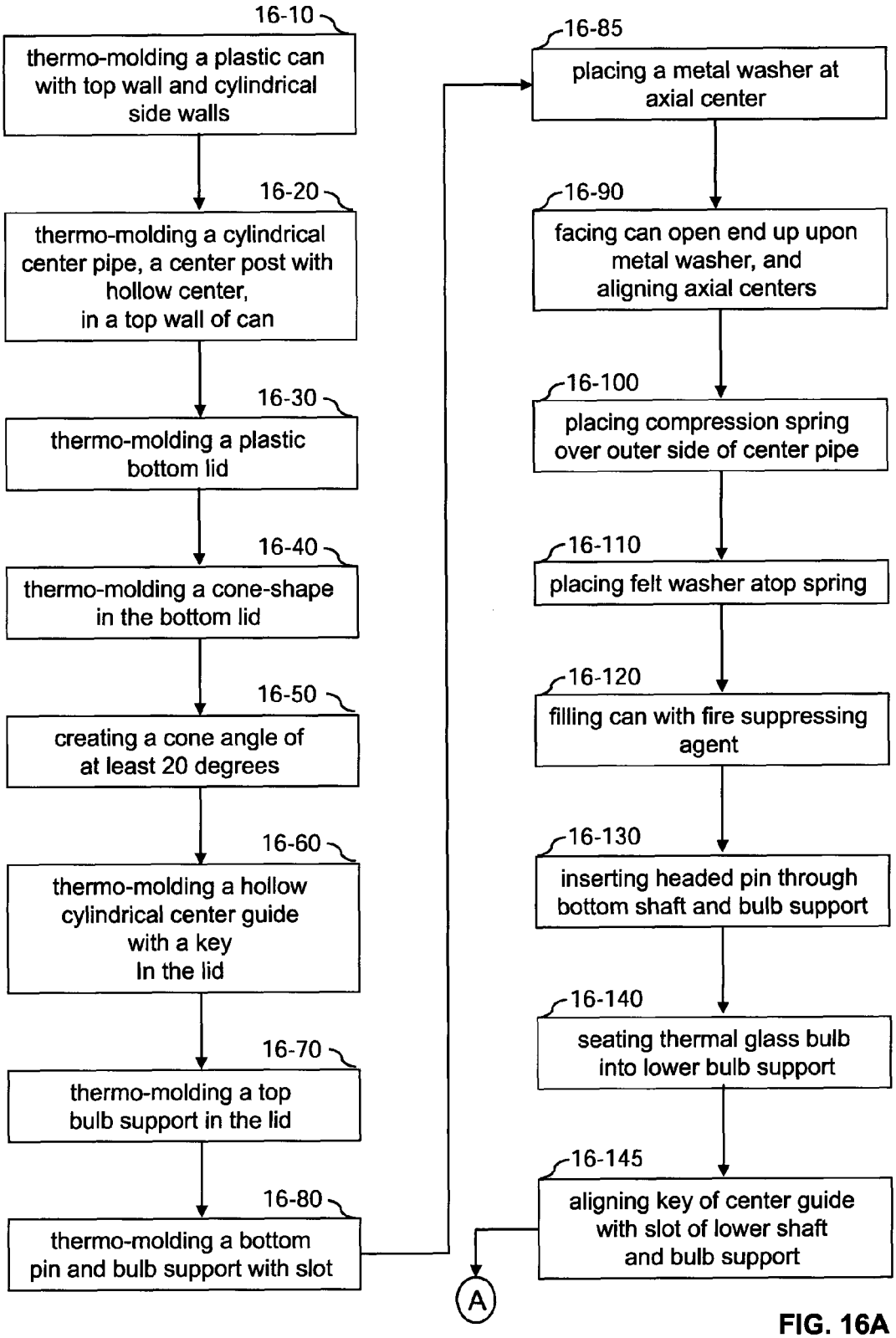
FIGS. 16A-16B show an exemplary method of manufacturing an automatic stovetop fire suppressor with a nail type center shaft, in accordance with an exemplary embodiment of the present invention.
Figure 16B:
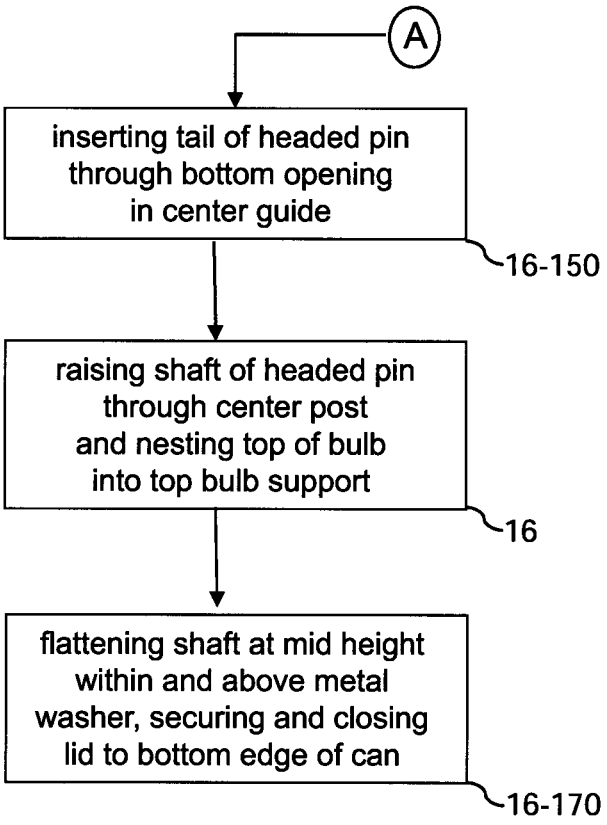

FIGS. 16A-16B show an exemplary method of manufacturing an automatic stovetop fire suppressor with a nail type center shaft, in accordance with an exemplary embodiment of the present invention. The manufacturing method includes: thermo-molding a plastic can with top wall and cylindrical side walls 16-10; thermo-molding a cylindrical center pipe, a center post with hollow center, in a top wall of can 16-20. In accordance with the exemplary embodiment shown, for example, in FIG. 4C, the cylindrical center post is integral to the top wall. Referring again to FIG. 16A, the manufacture method further includes: thermo-molding a plastic bottom lid 16-30; thermo-molding a cone-shape in the bottom lid 16-40; creating a cone angle of at least 20 degrees 16-50; thermo-molding a hollow cylindrical center guide with a key in the lid 16-60; thermo-molding a top bulb support in the lid 16-70. In accordance with an exemplary method embodiment, thermo-molding the upper bulb support may include thermo-molding the upper bulb support in a center guide. Referring again to FIG. 16A, the method further includes: thermo-molding a bottom pin and bulb support with slot 16-80; placing a metal washer at axial center 16-85; facing can open end up upon metal washer, and aligning axial centers 16-90; placing compression spring over outer diameter of center pipe 16-100; placing felt washer atop spring 16-110; and filling can with fire suppressing agent 16-120. The manufacturing method further includes: inserting headed pin through bottom shaft and bulb support 16-130; seating thermal glass bulb into lower bulb support 16-140; aligning key of center guide with slot of lower shaft and bulb support 16-145; inserting tail of headed pin through bottom opening in center guide 16-150; raising shaft of headed pin through center post and nesting top of bulb into top bulb support 16-160; flattening shaft at mid height within and above metal washer, securing and closing lid to bottom edge of can 16-170. In an alternate exemplary embodiment the manufacturing method may include deforming a tail of the headed pin, securing the headed pin to a magnet housing.

A plastic cone shaped bottom lid with center guide drops to expose a radial opening when a thermal glass bulb fractures in the presence of heat. The lid assembly can be thermo-molded. Similarly the can with cylindrical side wall, top wall, and integral center post guide may be thermo-molded. Embodiments of the present invention include off the shelf parts, such as, a cotter pin, a compression spring, and a thermal glass bulb.

The present invention utilizes both custom made parts and off the shelf parts reducing supply costs as compared to a fully customized composition. The design, in accordance with embodiments of the present invention, can be automated for greater efficiency of time and labor and can provide desired throughput. In accordance with embodiments of the present invention, the mounting assembly is attached at the factory, eliminating any assembly by the end user. In accordance with the present invention, the center shaft can be a nail type, a cotter pin, a customized nail, a headed pin, an L shaped bracket, or can otherwise vary across exemplary embodiments. The bottom bulb and center shaft support can also vary across embodiments while providing a catch for the center guide of the lid and a lower mount for the thermal glass bulb.

In an alternate embodiment of the present invention, an off the shelf aluminum can serves as the container and may have a diameter of four inches. A center post can be affixed to a top wall of the aluminum can with an off the shelf threaded insert. Alternate cans may be desired in alternate embodiments. The center post may be affixed to a top wall of the can by an alternate fastener. In still alternate embodiments the center post may not be integral to a plastic can and may instead be secured to the top wall of the same. Similarly, a center guide may not be integral to a thermo-molded cone shaped bottom lid but may be secured to the lid.

In part, by departing from an activation process that includes either of the rupture of metal segments in a bottom container wall or the shearing of a cross section at a designed breaking point, the present invention activates in the absence of an initiator charge. The initiator charge and interior designed breaking point are not shown in the perspective view of FIG. 3B but are shown, for example, in FIG. 3C and described in detail in parent application U.S. patent application Ser. No. 14/246,024, filed 4 Apr. 2014, which is incorporated by reference above.

By implementing an activation process which incorporates the release of compressed spring energy to deploy a lower a bottom lid, the present invention can employ a thermal glass bulb initiator. The thermal glass bulb initiator provides a multitude of desirable qualities to the automatic stovetop fire suppressor device and method. Embodiments of the present fire suppressor invention provide predictable, consistent, early, and quick activation. A self-contained stovetop fire suppressor which affords high safety, reliability, and performance is achieved through the present invention. Embodiments of the present invention employ a UL certified thermal glass bulb. By using a cone shaped bottom lid and by varying a drop height and cone angle, a desired distribution rate and pattern of fire suppressing agent can be achieved. In accordance with yet another alternate embodiment, the plastic bottom lid lacks a cone shape. In accordance with the present invention, the lid still lowers to be caught on a lower surface when thermal glass bulb fracture release a compressed spring.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended drawings.

What is claimed is:

1. A method of distributing a fire suppressing agent in an automatic stovetop fire suppressor, the method comprising:

acquiring a closed can container fire suppressor, the closed can container comprising a top wall and a cylindrical sidewall, and enclosed with a cone shaped bottom lid;

mounting the closed can container fire suppressor filled with the fire suppressing agent over a stovetop;

exposing a thermal glass bulb to heat from a cooking surface;

fracturing the thermal glass bulb due to heat;

releasing a compressed spring;

opening the closed can container by lowering the cone shaped bottom lid; and distributing the fire suppressing agent via the opened closed can container.

2. The method of claim 1, further comprising exposing a radial opening.

3. The method of claim 1, further comprising catching the cone shaped bottom lid.

* * * * *